US010100765B2

(12) United States Patent
Okazaki et al.

(10) Patent No.: US 10,100,765 B2
(45) Date of Patent: Oct. 16, 2018

(54) CONTROL APPARATUS FOR INTERNAL COMBUSTION ENGINE

(71) Applicant: TOYOTA JIDOSHA KABUSHIKI KAISHA, Toyota-shi, Aichi-ken (JP)

(72) Inventors: Shuntaro Okazaki, Sunto-gun (JP); Norihisa Nakagawa, Susono (JP); Yuji Yamaguchi, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/327,192

(22) PCT Filed: Jul. 22, 2015

(86) PCT No.: PCT/IB2015/001222
§ 371 (c)(1),
(2) Date: Jan. 18, 2017

(87) PCT Pub. No.: WO2016/016701
PCT Pub. Date: Feb. 4, 2016

(65) Prior Publication Data

US 2017/0145939 A1 May 25, 2017

(30) Foreign Application Priority Data

Jul. 28, 2014 (JP) ..... 2014-153321

(51) Int. Cl.
*F02D 41/02* (2006.01)
*F02D 41/14* (2006.01)
(Continued)

(52) U.S. Cl.
CPC ..... *F02D 41/0295* (2013.01); *F02D 41/1475* (2013.01); *F02D 41/2454* (2013.01); *F02D 2200/0814* (2013.01)

(58) Field of Classification Search
CPC ..... F02D 41/0295; F02D 41/2454; F02D 41/1475; F02D 2200/0814
(Continued)

(56) References Cited

U.S. PATENT DOCUMENTS

2008/0066727 A1* 3/2008 Kato ..... F02D 41/2461 123/703
2015/0330323 A1 11/2015 Aoki
2016/0061084 A1 3/2016 Okazaki et al.

FOREIGN PATENT DOCUMENTS

JP 2001-234787 8/2001
JP 2005-315110 11/2005
(Continued)

*Primary Examiner* — Mahmoud Gimie
(74) *Attorney, Agent, or Firm* — Finnegan, Henderson, Farabow, Garrett & Dunner, LLP

(57) ABSTRACT

A control apparatus for an internal combustion engine is provided. The control apparatus includes an electronic control unit. The electronic control unit is configured to: set a target air-fuel ratio at a lean air-fuel ratio that is leaner than a theoretical air-fuel ratio from time at which an output air-fuel ratio of a downstream-side air-fuel ratio sensor becomes equal to or lower than a rich determination air-fuel ratio; and set the target air-fuel ratio at a rich air-fuel ratio that is richer than the theoretical air-fuel ratio after an oxygen storage amount of the exhaust gas control catalyst becomes equal to or larger than the specified switching reference storage amount and the output air-fuel ratio of the downstream-side air-fuel ratio sensor becomes higher than the rich determination air-fuel ratio.

5 Claims, 18 Drawing Sheets

(51) Int. Cl.
*F02D 41/24* (2006.01)
*F02D 41/00* (2006.01)

(58) Field of Classification Search
USPC ..... 123/674
See application file for complete search history.

(56) References Cited

FOREIGN PATENT DOCUMENTS

| | | | |
|---|---|---|---|
| JP | 2008-75495 | | 4/2008 |
| JP | 5360312 | B1 | 12/2013 |
| JP | 2015-113827 | | 6/2015 |
| WO | WO 2014/118892 | A1 | 8/2014 |

* cited by examiner

CONTROL APPARATUS FOR INTERNAL COMBUSTION ENGINE

CROSS-REFERENCE TO RELATED APPLICATIONS

This application is a national phase application of International Application No. PCT/IB2015/001222, filed Jul. 22, 2015, and claims the priority of Japanese Application No. 2014-153321, filed Jul. 28, 2014, the content of both of which is incorporated herein by reference.

BACKGROUND OF THE INVENTION

1. Field of the Invention

The invention relates to a control apparatus for an internal combustion engine.

2. Description of Related Art

Conventionally, an internal combustion engine, in which an exhaust gas control catalyst is provided in an exhaust passage of the internal combustion engine, an air-fuel ratio sensor is provided on an upstream side of this exhaust gas c catalyst in an exhaust gas flow direction, and an oxygen sensor is provided on a downstream side of this exhaust gas control catalyst in the exhaust gas flow direction, has widely been known. A control apparatus for such an internal combustion engine controls an amount of fuel supplied to the internal combustion engine on the basis of output of each of these air-fuel ratio sensor and oxygen sensor.

As the control apparatus for such an internal combustion engine, for example, one that executes the following control has been known. When the output of the oxygen sensor is reversed from a value indicative of a richer air-fuel ratio (hereinafter, referred to as a "rich air-fuel ratio") than a theoretical air-fuel ratio to a value indicative of a leaner air-fuel ratio (hereinafter, referred to as a "lean air-fuel ratio") than the theoretical air-fuel ratio, a target air-fuel ratio of the exhaust gas that flows into the exhaust gas control catalyst is set at the rich air-fuel ratio. On the other hand, when the output of the oxygen sensor is reversed from the value indicative of the lean air-fuel ratio to the value indicative of the rich air-fuel ratio, the target air-fuel ratio is set at the lean air-fuel ratio (for example, Japanese Patent Application Publication No. 2008-075495 (JP 2008-075495 A)).

In particular, in the control apparatus described in JP 2008-075495 A, a deviation integration value is calculated by integrating a value that corresponds to a deviation between the output value of the oxygen sensor and a reference value corresponding to the target air-fuel ratio. In addition, the air-fuel ratio is controlled on the basis of the thus-calculated deviation integration value such that the air-fuel ratio of the exhaust gas flowing into the exhaust gas control catalyst corresponds to the target air-fuel ratio. Then, in the case where the output of the oxygen sensor is not reversed again even after a specified period has elapsed since the reversal of the output of the oxygen sensor, a learned value is corrected. According to JP 2008-075495 A, due to the above control, even when the learned value is largely deviated from an appropriate value, it can promptly be converged to the appropriate value.

SUMMARY OF THE INVENTION

By the way, the inventors of the subject application propose the following control apparatus for the internal combustion engine. In this control apparatus, a fuel injection amount supplied to a combustion chamber of the internal combustion engine is subjected to feedback control such that the air-fuel ratio of the exhaust gas flowing into the exhaust gas control catalyst becomes the target air-fuel ratio. The target air-fuel ratio is switched to the lean air-fuel ratio when an air-fuel ratio detected by a downstream-side air-fuel ratio sensor becomes equal to or lower than a rich determination air-fuel ratio that is richer than the theoretical air-fuel ratio. Thereafter, when an oxygen storage amount of the exhaust gas control catalyst becomes equal to or larger than a specified switching reference storage amount, the target air-fuel ratio is switched to the rich air-fuel ratio. In this way, outflows of NOx and oxygen from the exhaust gas control catalyst can be suppressed.

In addition, the inventors of the subject application propose that, in the control apparatus for executing such control, learning control for correcting an output air-fuel ratio of the downstream-side air-fuel ratio sensor and the like is executed. In this learning control, a lean oxygen amount integrated value is calculated, the lean oxygen amount integrated value being an absolute value of an integrated oxygen excess/short amount in an oxygen increase period that is from time at which the target air-fuel ratio is switched to the lean air-fuel ratio to time at which it is estimated that the oxygen storage amount of the exhaust gas control catalyst becomes equal to or larger than the switching reference storage amount. Furthermore, a rich oxygen amount integrated value is calculated, the rich oxygen amount integrated value being the absolute value of the integrated oxygen excess/short amount in an oxygen decrease period that is from time at which the target air-fuel ratio is switched to the rich air-fuel ratio to time at which the air-fuel ratio detected by the downstream-side air-fuel ratio sensor becomes equal to or lower than the rich determination air-fuel ratio. Then, an output air-fuel ratio of an upstream-side air-fuel ratio sensor and the like are corrected on the basis of these lean oxygen amount integrated value and rich oxygen amount integrated value such that a difference between these lean oxygen amount integrated value and rich oxygen amount integrated value becomes small. In this way, a deviation occurred in the output air-fuel ratio of the upstream-side air-fuel ratio sensor can be compensated.

By the way, during execution of the above-described air-fuel ratio control, there is a case where the air-fuel ratio of the exhaust gas flowing out of the exhaust gas control catalyst is maintained as the rich air-fuel ratio even after the target air-fuel ratio is switched from the rich air-fuel ratio to the lean air-fuel ratio and the oxygen storage amount of the exhaust gas control catalyst becomes equal to or larger than the switching reference storage amount. A reason for occurrence of such a situation is, for example, as follows. Even when the air-fuel ratio of the exhaust gas flowing into the exhaust gas control catalyst becomes the lean air-fuel ratio after the exhaust gas at the rich air-fuel ratio, a richness degree of which is relatively high, flows into the exhaust gas control catalyst, purification of unburned gas is not rapidly progressed in the exhaust gas control catalyst, and thus the unburned gas possibly continues to flow out of the exhaust gas control catalyst for a while.

Just as described, the air-fuel ratio of the exhaust gas flowing out of the exhaust gas control catalyst is maintained as the rich air-fuel ratio even after the oxygen storage amount of the exhaust gas control catalyst becomes equal to or larger than the switching reference storage amount. In such a case, when the target air-fuel ratio is switched from the lean air-fuel ratio to the rich air-fuel ratio, the output air-fuel ratio of the downstream-side air-fuel ratio sensor has become equal to or lower than the rich determination air-fuel ratio. Accordingly, the target air-fuel ratio is switched back to the lean air-fuel ratio immediately after being switched to the rich air-fuel ratio. In the case where the target air-fuel ratio is switched to the rich air-fuel ratio, just as described, the exhaust gas at the rich air-fuel ratio flows into the exhaust gas control catalyst while the unburned gas continues to flow out of the exhaust gas control catalyst. As a result, a period that the exhaust gas containing the unburned gas continues to flow out of the exhaust gas control catalyst is extended.

In addition, when the learning control as described above is executed, the oxygen decrease period becomes extremely shorter than the oxygen increase period. As a result, the rich oxygen amount integrated value becomes extremely smaller than the lean oxygen amount integrated value, and the output air-fuel ratio of the downstream-side air-fuel ratio sensor and the like are corrected on the basis of the difference therebetween. However, as described above, there is a case where the air-fuel ratio of the exhaust gas is maintained as the rich air-fuel ratio because the purification of the unburned gas is not rapidly progressed in the exhaust gas control catalyst. In this case, the deviation does not occur in the output air-fuel ratio of the upstream-side air-fuel ratio sensor. Accordingly, if the output air-fuel ratio of the upstream-side air-fuel ratio sensor and the like are corrected by the learning control in such a case, erroneous learning is performed.

The invention provides a control apparatus for an internal combustion engine that suppresses an unintended fluctuation in a target air-fuel ratio in the case where air-fuel ratio control as described above is executed. In addition, the invention provides a control apparatus for an internal combustion engine that suppresses erroneous learning in the case where the learning control as described above is executed.

A control apparatus for an internal combustion engine according to one aspect of the invention is provided. The internal combustion engine includes an exhaust gas control catalyst and a downstream-side air-fuel ratio sensor. The exhaust gas control catalyst is arranged in an exhaust passage of the internal combustion engine. The exhaust gas control catalyst is configured to store oxygen. The downstream-side air-fuel ratio sensor is arranged on a downstream side of the exhaust gas control catalyst in an exhaust gas flow direction in the exhaust passage. The downstream-side air-fuel ratio sensor is configured to detect an air-fuel ratio of the exhaust gas flowing out of the exhaust gas control catalyst. The control apparatus includes an electronic control unit. The electronic control unit is configured to: (i) execute feedback control of a fuel supply amount supplied to a combustion chamber of the internal combustion engine such that the air-fuel ratio of the exhaust gas flowing into the exhaust gas control catalyst becomes a target air-fuel ratio; (ii) set the target air-fuel ratio at a lean air-fuel ratio that is leaner than a theoretical air-fuel ratio from time at which an output air-fuel ratio of the downstream-side air-fuel ratio sensor becomes equal to or lower than a rich determination air-fuel ratio that is richer than the theoretical air-fuel ratio to time at which an oxygen storage amount of the exhaust gas control catalyst becomes equal to or larger than a specified switching reference storage amount that is smaller than a maximum oxygen storable amount and the output air-fuel ratio of the downstream-side air-fuel ratio sensor becomes higher than the rich determination air-fuel ratio; and (iii) set the target air-fuel ratio at a rich air-fuel ratio that is richer than the theoretical air-fuel ratio after the oxygen storage amount of the exhaust gas control catalyst becomes equal to or larger than the specified switching reference storage amount and the output air-fuel ratio of the downstream-side air-fuel ratio sensor becomes higher than the rich determination air-fuel ratio.

In the control apparatus according to the above aspect, the electronic control unit may be configured to set a leanness degree of the target air-fuel ratio such that the leanness degree of the target air-fuel ratio in a case where the oxygen storage amount of the exhaust gas control catalyst becomes equal to or larger than the switching reference storage amount after the target air-fuel ratio is switched to the lean air-fuel ratio and the output air-fuel ratio of the downstream-side air-fuel ratio sensor is equal to or lower than the rich determination air-fuel ratio is higher than the leanness degree of the target air-fuel ratio in a case where the oxygen storage amount is less than the switching reference storage amount.

In the control apparatus according to the above aspect, the electronic control unit may be configured to set the leanness degree of the target such that the leanness degree of the target air-fuel ratio is higher as the output air-fuel ratio of the downstream-side air-fuel ratio sensor is lowered.

In the control apparatus according to the above aspect, the electronic control unit may be configured to set the target air-fuel ratio at the rich air-fuel ratio that is richer than the theoretical air-fuel ratio from time at which the oxygen storage amount of the exhaust gas control catalyst becomes equal to or larger than the specified switching reference storage amount and the output air-fuel ratio of the downstream-side air-fuel ratio sensor becomes higher than the rich determination air-fuel ratio.

In the control apparatus according to the above aspect, the electronic control unit may be configured to execute learning control for correcting a parameter related to the feedback control on the basis of the output air-fuel ratio of the downstream-side air-fuel ratio sensor. The electronic control unit may be configured to calculate a first oxygen amount integrated value. The first oxygen amount integrated value may be an absolute value of an integrated oxygen excess/short amount in a first period that is from time at which the target air-fuel ratio is set at the lean air-fuel ratio to time at which it is estimated that the oxygen storage amount of the exhaust gas control catalyst becomes equal to or larger than the switching reference storage amount. The electronic control unit may be configured to calculate a second oxygen amount integrated value. The second oxygen amount integrated value may be the absolute value of the integrated oxygen excess/short amount in a second period that is from time at which the target air-fuel ratio is set at the rich air-fuel ratio to time at which the output air-fuel ratio of the downstream-side air-fuel ratio sensor becomes equal to or lower than the rich determination air-fuel ratio. The electronic control unit may be configured to correct a parameter related to the feedback control as the learning control such that a difference between the first oxygen amount integrated value and the second oxygen amount integrated value is decreased.

In the control apparatus according to the above aspect, the electronic control unit may be configured to correct the parameter related to the feedback control such that the air-fuel ratio of the exhaust gas flowing into the exhaust gas control catalyst in a case where the oxygen storage amount of the exhaust gas control catalyst becomes equal to or larger than the switching reference storage amount after the target air-fuel ratio is switched to the lean air-fuel ratio and the output air-fuel ratio of the downstream-side air-fuel ratio sensor is equal to or lower than the rich determination air-fuel ratio is leaner than that in a case where the oxygen storage amount is less than the switching reference storage amount.

According to the control apparatus for an internal combustion engine according to the above aspect, it is possible to suppress an unintended fluctuation in the target air-fuel ratio in the case where the air-fuel ratio control as described above is executed.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
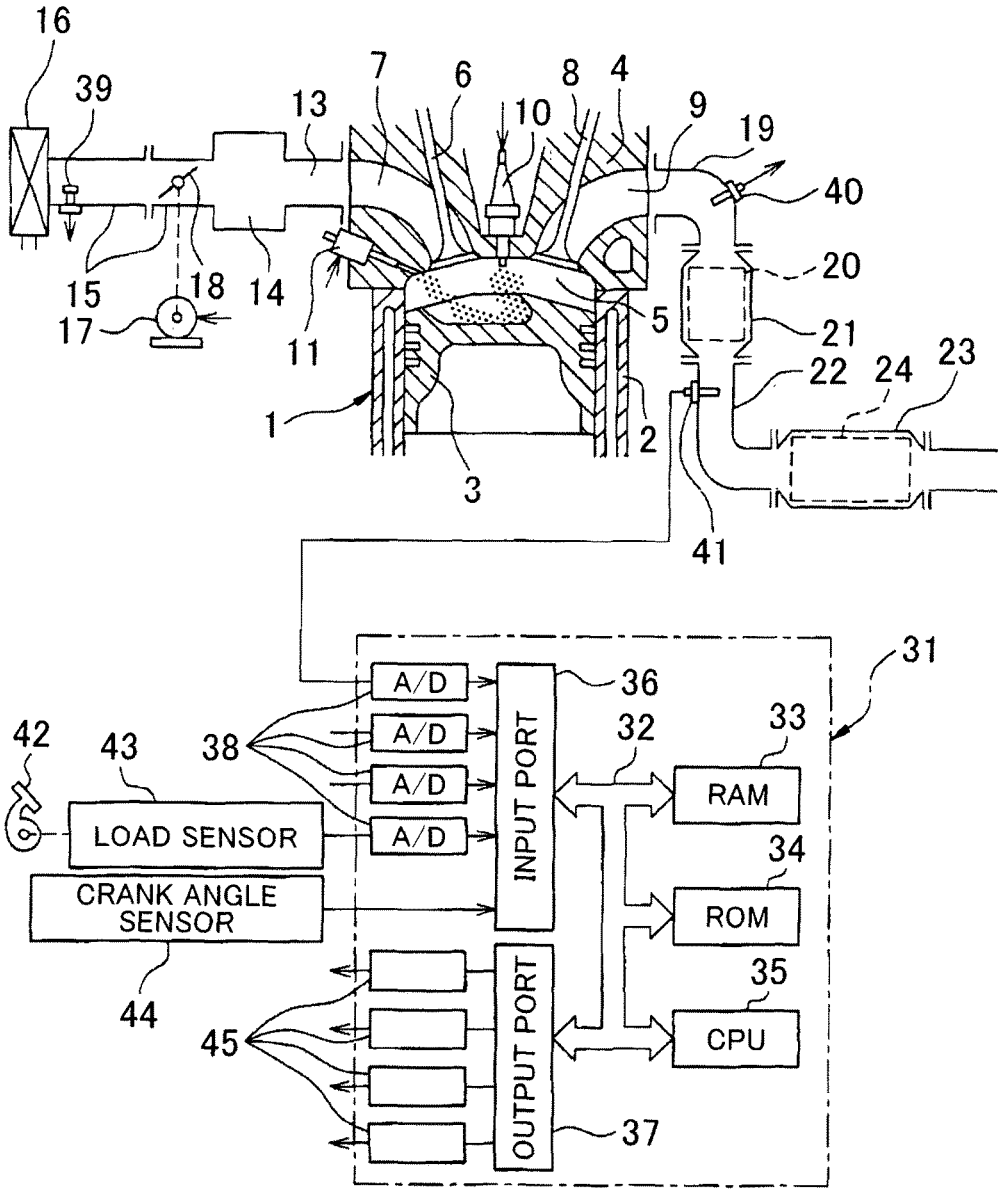
FIG. 1 is a schematic view of an internal combustion engine for which a control apparatus of the invention is used.

A detailed description will hereinafter be made on embodiments of the invention with reference to the drawings. Noted that similar components are denoted by the same reference numerals in the following description.

FIG. 1 is a schematic view of an internal combustion engine for which a control apparatus of the invention is used. In FIG. 1, 1 denotes an engine body, 2 denotes a cylinder block, 3 denotes a piston that reciprocates in the cylinder block 2, 4 denotes a cylinder head fixed on the cylinder block 2, 5 denotes a combustion chamber formed between the piston 3 and the cylinder head 4, 6 denotes an intake valve, 7 denotes an intake port, 8 denotes an exhaust valve, and 9 denotes an exhaust port. The intake valve 6 opens or closes the intake port 7, and the exhaust valve 8 opens or closes the exhaust port 9.

As shown in FIG. 1, an ignition plug 10 is arranged at a center of an inner wall surface of the cylinder head 4, and a fuel injection valve 11 is arranged in a periphery of the inner wall surface of the cylinder head 4. The ignition plug 10 is configured to generate a spark in correspondence with an ignition signal. The fuel injection valve 11 injects a specified amount of fuel into the combustion chamber 5 in correspondence with an injection signal. Noted that the fuel injection valve 11 may be arranged to inject the fuel into the intake port 7. In this embodiment, gasoline, of which theoretical air-fuel ratio is 14.6, is used as the fuel. However, another type of the fuel may be used for the internal combustion engine of this embodiment.

The intake port 7 of each cylinder is coupled to a surge tank 14 via a corresponding intake branch pipe 13, and the surge tank 14 is coupled to an air cleaner 16 via an intake pipe 15. The intake port 7, the intake branch pipe 13, the surge tank 14, and the intake pipe 15 form an intake passage. In addition, a throttle valve 18 that is driven by a throttle valve drive actuator 17 is arranged in the intake pipe 15. The throttle valve 18 is turned by the throttle valve drive actuator 17 so as to be able to change an area of an opening of the intake passage.

Meanwhile, the exhaust port 9 of each of the cylinder is coupled to an exhaust manifold 19. The exhaust manifold 19 has plural branch sections respectively coupled to the exhaust ports 9 and an aggregated section in which these branch sections are aggregated. The aggregated section of the exhaust manifold 19 is coupled to an upstream-side casing 21 in which an upstream-side exhaust gas control catalyst 20 is installed. The upstream-side casing 21 is coupled to a downstream-side casing 23 in which a downstream-side exhaust gas control catalyst 24 is installed via an exhaust pipe 22. The exhaust port 9, the exhaust manifold 19, the upstream-side casing 21, the exhaust pipe 22, and the downstream-side casing 23 form an exhaust passage.

An electronic control unit (ECU) 31 is constructed of a digital computer and is equipped with a random access memory (RAM) 33, a read only memory (ROM) 34, a microprocessor (CPU) 35, an input port 36, and an output port 37 that are interconnected via a bidirectional bus 32. An airflow meter 39 for detecting a flow rate of the air flowing through the intake pipe 15 is arranged in the intake pipe 15, and the input port 36 receives output of this airflow meter 39 via a corresponding AD converter 38. An upstream-side air-fuel ratio sensor (upstream-side air-fuel ratio detector) 40 that detects an air-fuel ratio of the exhaust gas flowing through the exhaust manifold 19 (that is, the exhaust gas flowing into the upstream-side exhaust gas control catalyst 20) is arranged in the aggregated section of the exhaust manifold 19. In addition, a downstream-side air-fuel ratio sensor (downstream-side air-fuel ratio detector) 41 that detects an air-fuel ratio of the exhaust gas flowing through the exhaust pipe 22 (that is, the exhaust gas flowing out of the upstream-side exhaust gas control catalyst 20 and flowing into the downstream-side exhaust gas control catalyst 24) is arranged in the exhaust pipe 22. The input port 36 also receives output of each of these air-fuel ratio sensors 40, 41 via the corresponding AD converter 38.

In addition, a load sensor 43 for generating output voltage that is proportional to a depression amount of an accelerator pedal 42 is connected to the accelerator pedal 42, and the input port 36 receives the output voltage of the load sensor 43 via the corresponding AD converter 38. A crank angle sensor 44 generates an output pulse every time a crankshaft rotates by 15 degrees, for example, and the input port 36 receives this output pulse. In the CPU 35, an engine speed is calculated from the output pulse of this crank angle sensor 44. Meanwhile, the output port 37 is connected to the ignition plug 10, the fuel injection valve 11, and the throttle valve drive actuator 17 via corresponding drive circuits 45. Noted that the ECU 31 functions as the control apparatus that executes control of the internal combustion engine.

Noted that the internal combustion engine according to this embodiment is a non-supercharged internal combustion engine that uses gasoline as the fuel; however, a configuration of the internal combustion engine according to the invention is not limited to the above configuration. For example, cylinder arrangement, a fuel injection mode, configurations of intake and exhaust systems, configurations of valve mechanisms, presence or absence of a supercharger, a supercharging mode, and the like of the internal combustion engine according to the invention may differ from those of the above internal combustion engine.

The upstream-side exhaust gas control catalyst 20 and the downstream-side exhaust gas control catalyst 24 have similar configurations. Each of the exhaust gas control catalysts 20, 24 is a three-way catalyst having an oxygen storage capacity. More specifically, in each of the exhaust gas control catalysts 20, 24, a base material made of a ceramic carries a precious metal having a catalytic action (for example, platinum (Pt)) and a substance having the oxygen storage capacity (for example, ceria ($CeO_2$)). When reaching a specified activation temperature, each of the exhaust gas control catalysts 20, 24 exerts the oxygen storage capacity in addition to the catalytic action for purifying unburned gas (HC, CO, and the like) and nitrogen oxide (NOx) simultaneously.

Regarding the oxygen storage capacities of the exhaust gas control catalysts 20, 24, the exhaust gas control catalysts 20, 24 store oxygen in the exhaust gas when the air-fuel ratio of the exhaust gas flowing into each of the exhaust gas control catalysts 20, 24 is leaner than the theoretical air-fuel ratio (is a lean air-fuel ratio). On the other hand, the exhaust gas control catalysts 20, 24 release oxygen stored in the exhaust gas control catalysts 20, 24 when the air-fuel ratio of the exhaust gas flowing therein is richer than the theoretical air-fuel ratio (is a rich air-fuel ratio).

Figure 2A:
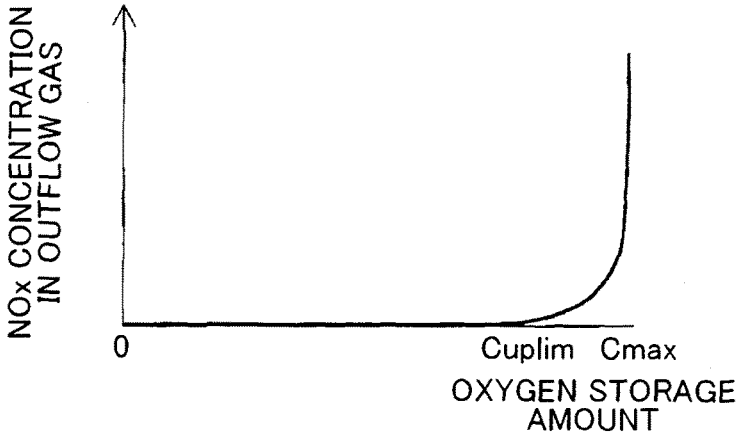
FIG. 2A is a graph for showing a relationship between an oxygen storage amount of an exhaust gas control catalyst and a NOx concentration in exhaust gas flowing out of the exhaust gas control catalyst.

Since each of the exhaust gas control catalysts 20, 24 has the catalytic action and the oxygen storage capacity, each of the exhaust gas control catalysts 20, 24 has an purification action of NOx and the unburned gas in accordance with an oxygen storage amount. More specifically, as shown in FIG. 2A, in the case where the air-fuel ratio of the exhaust gas flowing into each of the exhaust gas control catalysts 20, 24 is the lean air-fuel ratio and the oxygen storage amount is small, oxygen in the exhaust gas is stored in each of the exhaust gas control catalysts 20, 24. In conjunction with this, NOx in the exhaust gas is reduced and purified. Then, when the oxygen storage amount is increased, concentrations of oxygen and NOx in the exhaust gas flowing out of each of the exhaust gas control catalysts 20, 24 are rapidly increased from a certain storage amount (Cuplim in the drawing) near a maximum oxygen storable amount Cmax.

Figure 2B:
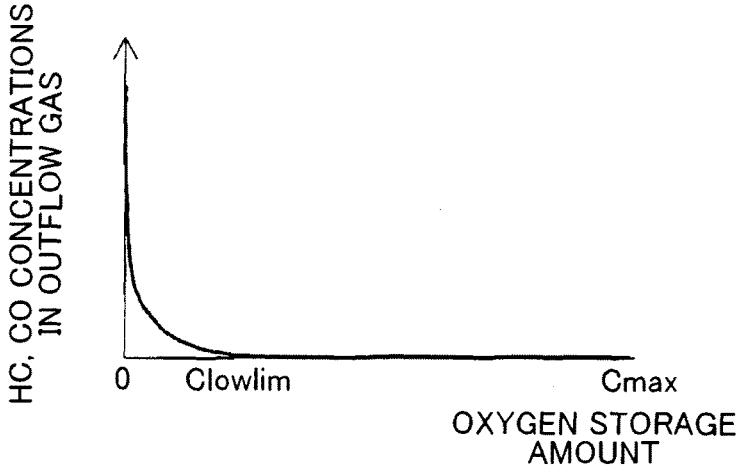
FIG. 2B is a graph for showing a relationship between the oxygen storage amount of the exhaust gas control catalyst and HC, CO concentrations in the exhaust gas flowing out of the exhaust gas control catalyst.

On the other hand, as shown in FIG. 2B, in the case where the air-fuel ratio of the exhaust gas flowing into each of the exhaust gas control catalysts 20, 24 is the rich air-fuel ratio and the oxygen storage amount is large, oxygen stored in each of the exhaust gas control catalysts 20, 24 is released, and the unburned gas in the exhaust gas is oxidized and purified. Then, when the oxygen storage amount is decreased, a concentration of the unburned gas in the exhaust gas flowing out of each of the exhaust gas control catalysts 20, 24 is rapidly increased from a certain storage amount (Clowlim in the drawing) near zero.

As described above, according to the exhaust gas control catalysts 20, 24 used in this embodiment, purification characteristics of NOx and the unburned gas in the exhaust gas are changed in accordance with the air-fuel ratio of the exhaust gas flowing into each of the exhaust gas control catalysts 20, 24 and the oxygen storage amount. Noted that each of the exhaust gas control catalysts 20, 24 may be a catalyst other than the three-way catalyst as long as each of them has the catalytic action and the oxygen storage capacity.

Figure 3:
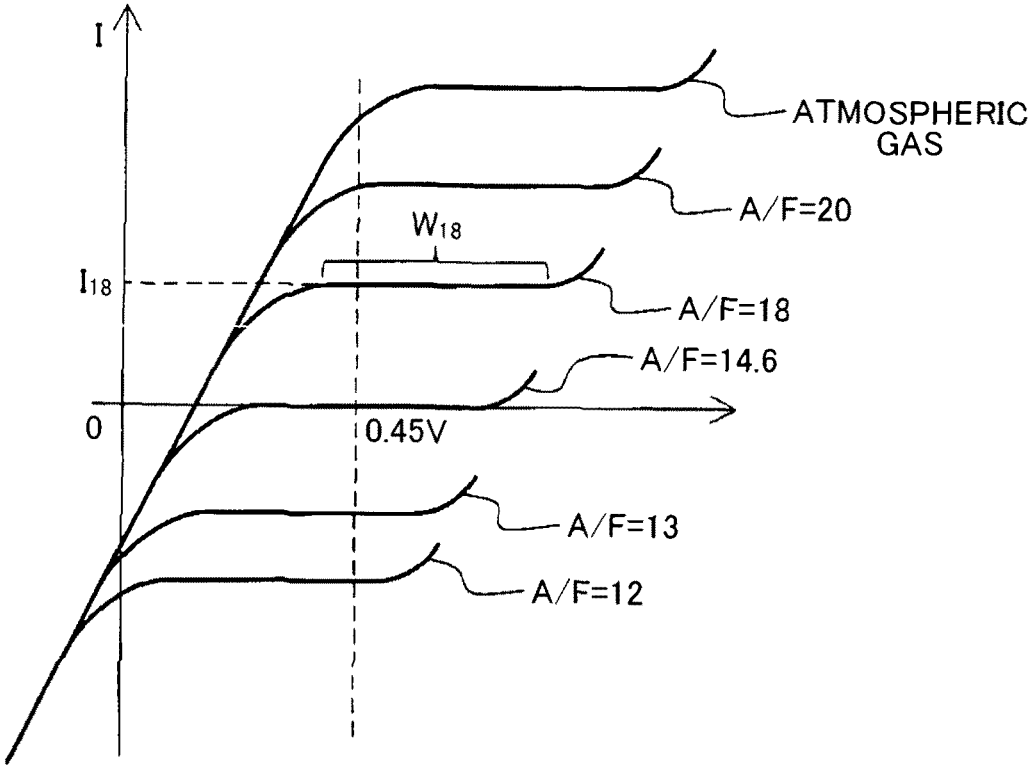
FIG. 3 is a graph for showing a relationship between a sensor application voltage at each exhaust air-fuel ratio and an output current.
Figure 4:
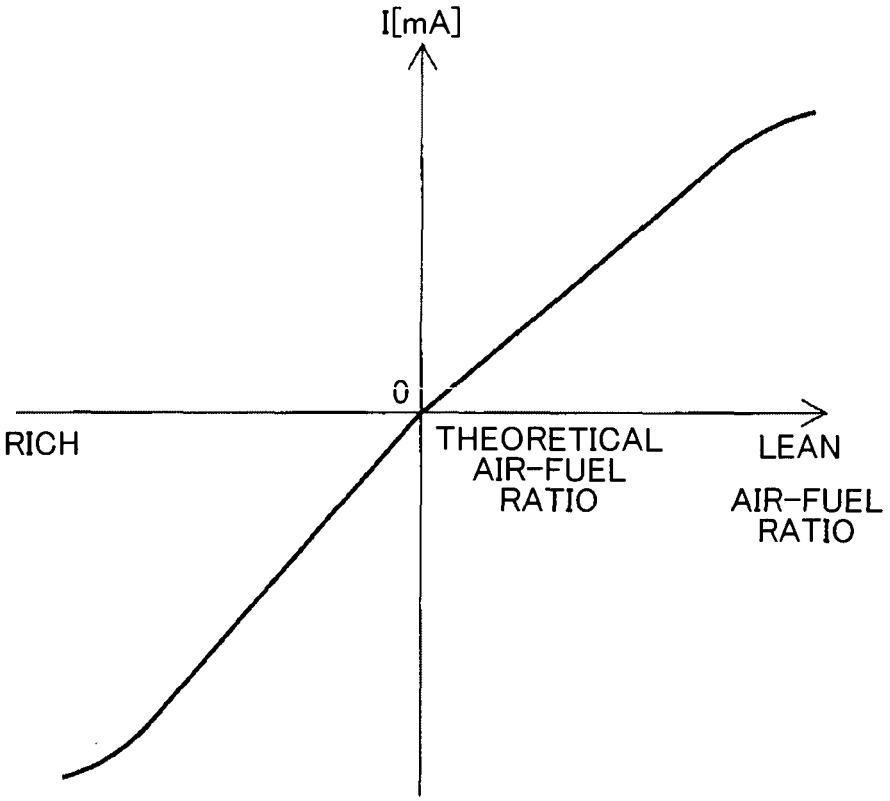
FIG. 4 is a graph for showing a relationship between the exhaust air-fuel ratio and the output current when the sensor application voltage is constant.

Next, a description will be made on output characteristics of the air-fuel ratio sensors 40, 41 in this embodiment with reference to FIG. 3 and FIG. 4. FIG. 3 is a graph for showing a voltage-current (V-I) characteristic of the air-fuel ratio sensors 40, 41 in this embodiment, and FIG. 4 is a graph for showing a relationship between the air-fuel ratio of the exhaust gas distributed around the air-fuel ratio sensors 40, 41 (hereinafter, referred to as an "exhaust air-fuel ratio") and an output current I when an application voltage is maintained to be constant. Noted that, in this embodiment, air-fuel ratio sensors with the same configurations are used as the air-fuel ratio sensors 40, 41.

As it can be understood from FIG. 3, the output current I is increased as the exhaust air-fuel ratio is increased (becomes leaner) in each of the air-fuel ratio sensors 40, 41 of this embodiment. In addition, in a V-I line of each exhaust air-fuel ratio, a region substantially parallel to a V-axis, that is, a region where the output current is hardly changed with a change in the sensor application voltage is present. This voltage region is referred to as a limiting current region, and a current at this time is referred to as a limiting current. In FIG. 3, the limiting current region and the limiting current at a time when the exhaust air-fuel ratio is 18 are respectively indicated by $W_{18}$ and $I_{18}$. Accordingly, it can be said that each of the air-fuel ratio sensors 40, 41 is an air-fuel ratio sensor of a limiting current type.

FIG. 4 is a graph for showing the relationship between the exhaust air-fuel ratio and the output current I when the application voltage is constant at approximately 0.45 V. As it can be understood from FIG. 4, in each of the air-fuel ratio sensors 40, 41, the output current is changed linearly with respect to (proportionally to) the exhaust air-fuel ratio such that the output current I from each of the air-fuel ratio sensors 40, 41 is increased as the exhaust air-fuel ratio is increased (becomes leaner). In addition, each of the air-fuel ratio sensors 40, 41 is configured that the output current I becomes zero when the exhaust air-fuel ratio is the theoretical air-fuel ratio. Furthermore, when the exhaust air-fuel ratio is increased to a certain ratio or higher, or lowered to a certain ratio or lower, a rate of the change in the output current with respect to the change in the exhaust air-fuel ratio is lowered.

Noted that the air-fuel ratio sensor of the limiting current type is used as each of the air-fuel ratio sensors 40, 41 in the above example. However, any air-fuel ratio sensor, such as an air-fuel ratio sensor other than that of the limiting current type, may be used as each of the air-fuel ratio sensors 40, 41 as long as the output current is changed linearly with respect to the exhaust air-fuel ratio. In addition, the air-fuel ratio sensors 40, 41 may be air-fuel ratio sensors with structures different from each other.

Next, a description will be made on an overview of basic air-fuel ratio control in the control apparatus for the internal combustion engine of this embodiment. In the air-fuel ratio control of this embodiment, feedback control for controlling a fuel supply amount (fuel injection amount) supplied by the fuel injection valve 11 to the combustion chamber of the internal combustion engine is executed on the basis of the output air-fuel ratio AFup of the upstream-side air-fuel ratio sensor 40 such that the output air-fuel ratio AFup of the upstream-side air-fuel ratio sensor 40 becomes a target air-fuel ratio. Noted that the "output air-fuel ratio" means an air-fuel ratio corresponding to an output value of the air-fuel ratio sensor.

Meanwhile, in the air-fuel ratio control of this embodiment, target air-fuel ratio setting control for setting the target air-fuel ratio on the basis of the output air-fuel ratio AFdwn of the downstream-side air-fuel ratio sensor 41 and the like is executed. In the target air-fuel ratio setting control, when the output air-fuel ratio AFdwn of the downstream-side air-fuel ratio sensor 41 becomes the rich air-fuel ratio, the target air-fuel ratio is set at a lean setting air-fuel ratio and is maintained at the air-fuel ratio thereafter. The lean setting air-fuel ratio is a predetermined air-fuel ratio that is leaner than the theoretical air-fuel ratio (an air-fuel ratio as control center) to a certain degree, and is set to be approximately 14.65 to 20, preferably 14.65 to 18, more preferably 14.65 to 16, for example. The lean setting air-fuel ratio can also be expressed as an air-fuel ratio that is obtained by adding a lean correction amount to the air-fuel ratio as the control center (the theoretical air-fuel ratio in this embodiment). In addition, in this embodiment, it is determined that the output air-fuel ratio AFdwn of the downstream-side air-fuel ratio sensor 41 becomes the rich air-fuel ratio when the output air-fuel ratio Afdwn of the downstream-side air-fuel ratio sensor 41 becomes equal to or lower than a rich determination air-fuel ratio (for example, 14.55) that is slightly richer than the theoretical air-fuel ratio.

When the target air-fuel ratio is changed to the lean setting air-fuel ratio, an oxygen excess/short amount of the exhaust gas flowing into the upstream-side exhaust gas control catalyst 20 is integrated. The oxygen excess/short amount means an amount of oxygen that becomes excessive or an amount of oxygen that becomes short (excess amounts of the unburned gas and the like) when it is attempted to set the air-fuel ratio of the exhaust gas flowing into the upstream-side exhaust gas control catalyst 20 at the theoretical air-fuel ratio. In particular, when the target air-fuel ratio is the lean setting air-fuel ratio, the amount of oxygen in the exhaust gas flowing into the upstream-side exhaust gas control catalyst 20 is excessive, and this excess amount of oxygen is stored in the upstream-side exhaust gas control catalyst 20. Accordingly, it can be said that an integrated value of the oxygen excess/short amount (hereinafter, referred to as an "integrated oxygen excess/short amount") is an estimated value of an oxygen storage amount OSA of the upstream-side exhaust gas control catalyst 20.

Noted that the oxygen excess/short amount is calculated on the basis of the output air-fuel ratio AFup of the upstream-side air-fuel ratio sensor 40, and either an estimated value of an intake air amount to the combustion chamber 5 that is calculated on the basis of the output of the airflow meter 39 and the like or the fuel supply amount from the fuel injection valve 11, and the like. More specifically, an oxygen excess/short amount OED is, for example, calculated by the following equation (1).

$$OED=0.23\cdot sQi/(AF\text{up}-AFR). \quad (1)$$

where 0.23 is an oxygen concentration in the air, Qi is the fuel injection amount, AFup is the output air-fuel ratio AFup of the upstream-side air-fuel ratio sensor 40, and AFR is the air-fuel ratio as the control center (the theoretical air-fuel ratio in this embodiment).

When the integrated oxygen excess/short amount, which is obtained by integrating the thus-calculated oxygen excess/short amount, becomes equal to or larger than a predetermined switching reference value (corresponding to a predetermined switching reference storage amount Cref), the target air-fuel ratio that has been maintained at the lean setting air-fuel ratio is set at a rich setting air-fuel ratio and is maintained at the air-fuel ratio thereafter. The rich setting air-fuel ratio is a predetermined air-fuel ratio that is richer than the theoretical air-fuel ratio (the air-fuel ratio as the control center) to a certain degree, and is set to be approximately 12 to 14.58, preferably 13 to 14.57, more preferably 14 to 14.55, for example. The rich setting air-fuel ratio can also be expressed as an air-fuel ratio that is obtained by subtracting a rich correction amount from the air-fuel ratio as the control center (the theoretical air-fuel ratio in this embodiment). Noted that, in this embodiment, a difference of the rich setting air-fuel ratio from the theoretical air-fuel ratio (a richness degree) is set to be equal to or smaller than a difference of the lean setting air-fuel ratio from the theoretical air-fuel ratio (a leanness degree).

Then, when the output air-fuel ratio AFdwn of the downstream-side air-fuel ratio sensor 41 becomes equal to or lower than the rich determination air-fuel ratio again, the target air-fuel ratio is set at the lean setting air-fuel ratio again, and a similar operation is repeated thereafter. Just as described, in this embodiment, the target air-fuel ratio of the exhaust gas flowing into the upstream-side exhaust gas control catalyst 20 is alternately set at the lean setting air-fuel ratio and the rich setting air-fuel ratio.

However, even when the control as described above is executed, there is a case where the actual oxygen storage amount of the upstream-side exhaust gas control catalyst 20 reaches a maximum oxygen storable amount before the integrated oxygen excess/short amount reaches the switching reference value. For example, a decrease in the maximum oxygen storable amount of the upstream-side exhaust gas control catalyst 20 and a temporal rapid change in the air-fuel ratio of the exhaust gas flowing into the upstream-side exhaust gas control catalyst 20 can be mentioned as causes of such a case. When the oxygen storage amount reaches the maximum oxygen storable amount, just as described, the exhaust gas at the lean air-fuel ratio flows out of the upstream-side exhaust gas control catalyst 20. In view of this, in this embodiment, when the output air-fuel ratio AFdwn of the downstream-side air-fuel ratio sensor 41 becomes the lean air-fuel ratio, the target air-fuel ratio is switched to the rich setting air-fuel ratio. In particular, in this embodiment, it is determined that the output air-fuel ratio AFdwn of the downstream-side air-fuel ratio sensor 41 becomes the lean air-fuel ratio when the output air-fuel ratio AFdwn of the downstream-side air-fuel ratio sensor 41 becomes equal to or higher than a lean determination air-fuel ratio (for example, 14.65) that is slightly leaner than the theoretical air-fuel ratio.

Figure 5:
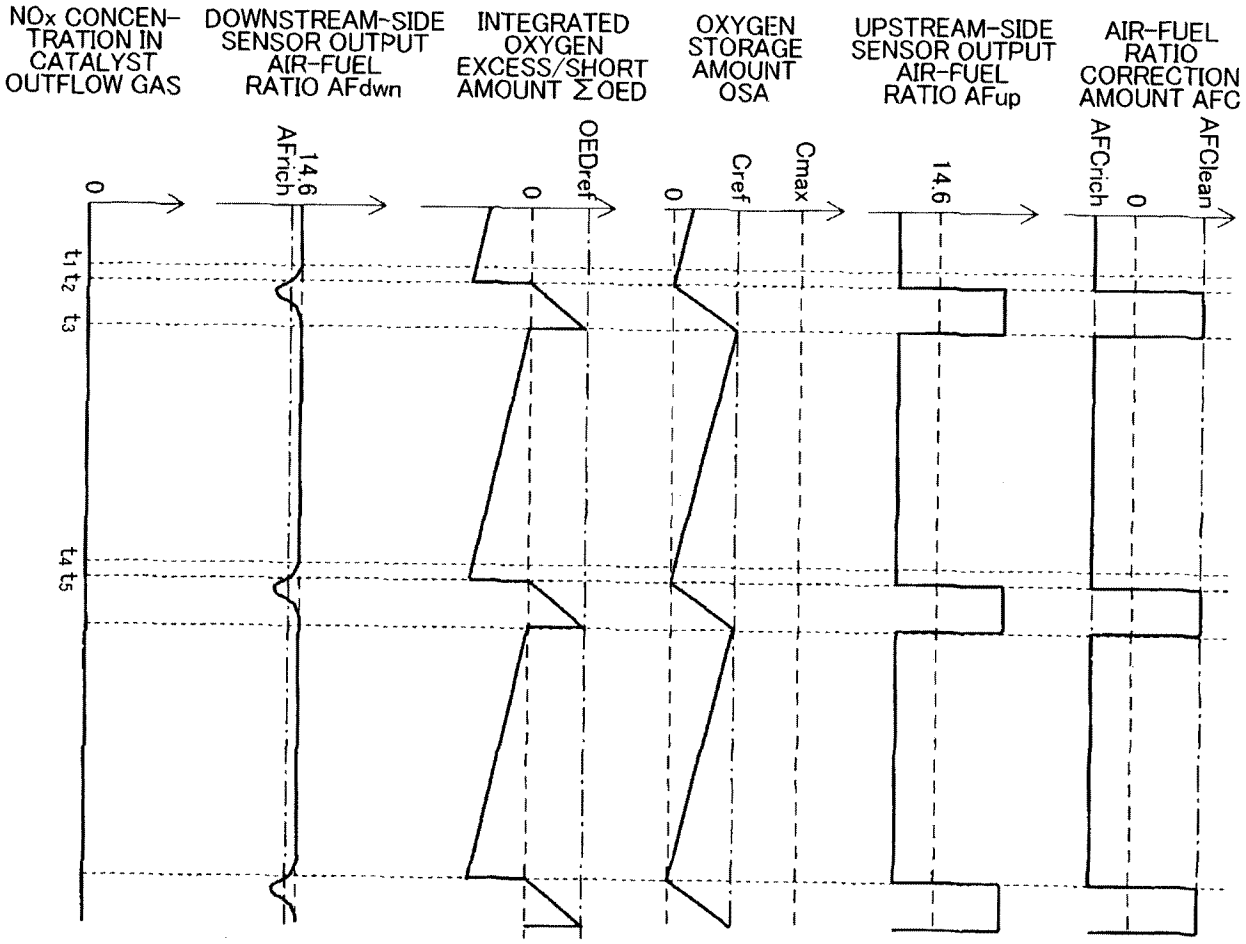
FIG. 5 includes time charts of an air-fuel ratio correction amount and the like when air-fuel ratio control is executed.

A specific description will be made on an operation as described above with reference to FIG. 5. FIG. 5 includes time charts of an air-fuel ratio correction amount AFC, an output air-fuel ratio AFup of the upstream-side air-fuel ratio sensor 40, the oxygen storage amount OSA of the upstream-side exhaust gas control catalyst 20, an integrated oxygen excess/short amount ΣOED, an output air-fuel ratio AFdwn of the downstream-side air-fuel ratio sensor 41, and a NOx concentration in the exhaust gas flowing out of the upstream-side exhaust gas control catalyst 20 when the air-fuel ratio control of this embodiment is executed.

Noted that the air-fuel ratio correction amount AFC is a correction amount related to the target air-fuel ratio of the exhaust gas flowing into the upstream-side exhaust gas control catalyst 20. When the air-fuel ratio correction amount AFC is zero, the target air-fuel ratio is set at an air-fuel ratio (the theoretical air-fuel ratio in this embodiment) that is equal to the air-fuel ratio as the control center (hereinafter, referred to as a "control center air-fuel ratio"). When the air-fuel ratio correction amount AFC is a positive value, the target air-fuel ratio is set at an air-fuel ratio (the lean air-fuel ratio in this embodiment) that is leaner than the control center air-fuel ratio. When the air-fuel ratio correction amount AFC is a negative value, the target air-fuel ratio is set at an air-fuel ratio (the rich air-fuel ratio in this embodiment) that is richer than the control center air-fuel ratio. In addition, the "control center air-fuel ratio" means an air-fuel ratio at which the air-fuel ratio correction amount AFC is added in accordance with an engine operation state, that is, an air-fuel ratio that serves as a reference when the target air-fuel ratio fluctuates in accordance with the air-fuel ratio correction amount AFC.

In an illustrated example, the air-fuel ratio correction amount AFC is set to a rich setting correction amount AFCrich (corresponding to the rich setting air-fuel ratio) in a state prior to time $t_1$. That is, the target air-fuel ratio is set at the rich air-fuel ratio, and in conjunction with this, the output air-fuel ratio AFup of the upstream-side air-fuel ratio sensor 40 becomes the rich air-fuel ratio. The unburned gas that is contained in the exhaust gas flowing into the upstream-side exhaust gas control catalyst 20 is purified by the upstream-side exhaust gas control catalyst 20, and in conjunction with this, the oxygen storage amount OSA of the upstream-side exhaust gas control catalyst 20 is gradually decreased. Accordingly, the integrated oxygen excess/short amount ΣOED is also gradually decreased. Since the unburned gas is not contained in the exhaust gas flowing out of the upstream-side exhaust gas control catalyst 20 due to purification in the upstream-side exhaust gas control catalyst 20, the output air-fuel ratio AFdwn of the downstream-side air-fuel ratio sensor 41 substantially becomes equal to the theoretical air-fuel ratio. Since the air-fuel ratio of the exhaust gas flowing into the upstream-side exhaust gas control catalyst 20 is the rich air-fuel ratio, a NOx discharge amount from the upstream-side exhaust gas control catalyst 20 becomes approximately zero.

When the oxygen storage amount OSA of the upstream-side exhaust gas control catalyst 20 is gradually decreased, the oxygen storage amount OSA approximates zero at the time $t_1$. In conjunction with this, some of the unburned gas flowing into the upstream-side exhaust gas control catalyst 20 is not purified by the upstream-side exhaust gas control catalyst 20 but starts flowing out thereof as is. Accordingly, the output air-fuel ratio AFdwn of the downstream-side air-fuel ratio sensor 41 is gradually lowered at the time $t_1$ onward. As a result, at time $t_2$, the output air-fuel ratio AFdwn of the downstream-side air-fuel ratio sensor 41 reaches a rich determination air-fuel ratio AFrich.

In this embodiment, when the output air-fuel ratio AFdwn of the downstream-side air-fuel ratio sensor 41 becomes equal to or lower than the rich determination air-fuel ratio AFrich, the air-fuel ratio correction amount AFC is switched to a lean setting correction amount AFClean (corresponding to the lean setting air-fuel ratio) in order to increase the oxygen storage amount OSA. Accordingly, the target air-fuel ratio is switched from the rich air-fuel ratio to the lean air-fuel ratio. In addition, the integrated oxygen excess/short amount ΣOED is reset to zero at this time.

Noted that, in this embodiment, the air-fuel ratio correction amount AFC is switched after the output air-fuel ratio AFdwn of the downstream-side air-fuel ratio sensor 41 reaches the rich determination air-fuel ratio AFrich. This is because there is a case where the air-fuel ratio of the exhaust gas flowing out of the upstream-side exhaust gas control catalyst 20 is very slightly deviated from the theoretical air-fuel ratio even when the oxygen storage amount of the upstream-side exhaust gas control catalyst 20 is sufficient. Conversely, when the oxygen storage amount of the upstream-side exhaust gas control catalyst 20 is sufficient, the rich determination air-fuel ratio is set at such an air-fuel ratio that the air-fuel ratio of the exhaust gas flowing out of the upstream-side exhaust gas control catalyst 20 cannot reach.

When the target air-fuel ratio is switched to the lean air-fuel ratio at the time $t_2$, the air-fuel ratio of the exhaust gas flowing into the upstream-side exhaust gas control catalyst 20 is changed from the rich air-fuel ratio to the lean air-fuel ratio. In conjunction with this, the output air-fuel ratio AFup of the upstream-side air-fuel ratio sensor 40 becomes the lean air-fuel ratio (there is actually a delay in changing of the air-fuel ratio of the exhaust gas flowing into the upstream-side exhaust gas control catalyst 20 after the target air-fuel ratio is switched; however, they occur simultaneously in the illustrated example as a matter of convenience). When the air-fuel ratio of the exhaust gas flowing into the upstream-side exhaust gas control catalyst 20 is changed to the lean air-fuel ratio at the time $t_2$, the oxygen storage amount OSA of the upstream-side exhaust gas control catalyst 20 is increased. In conjunction with this, the integrated oxygen excess/short amount ΣOED is also gradually increased.

Accordingly, the air-fuel ratio of the exhaust gas flowing out of the upstream-side exhaust gas control catalyst 20 is changed to the theoretical air-fuel ratio, and the output air-fuel ratio AFdwn of the downstream-side air-fuel ratio sensor 41 is also converged to the theoretical air-fuel ratio. At this time, the air-fuel ratio of the exhaust gas flowing into the upstream-side exhaust gas control catalyst 20 is the lean air-fuel ratio. However, since the oxygen storage capacity of the upstream-side exhaust gas control catalyst 20 has enough room, oxygen in the inflow exhaust gas is stored in the upstream-side exhaust gas control catalyst 20, and NOx is reduced and purified. Therefore, the NOx discharge amount from the upstream-side exhaust gas control catalyst 20 becomes approximately zero.

Thereafter, when the oxygen storage amount OSA of the upstream-side exhaust gas control catalyst 20 is increased, the oxygen storage amount OSA of the upstream-side exhaust gas control catalyst 20 reaches the switching reference storage amount Cref at time $t_3$. Accordingly, the integrated oxygen excess/short amount ΣOED reaches a switching reference value OEDref that corresponds to the switching reference storage amount Cref. In this embodiment, when the integrated oxygen excess/short amount ΣOED becomes equal to or larger than the switching reference value OEDref, the air-fuel ratio correction amount AFC is switched to the rich setting correction amount AFCrich, so as to stop storing oxygen in the upstream-side exhaust gas control catalyst 20. Thus, the target air-fuel ratio is set at the rich air-fuel ratio. In addition, at this time, the integrated oxygen excess/short amount ΣOED is reset to zero.

Here, in the example shown in FIG. 5, the oxygen storage amount OSA is decreased at the same time as the target air-fuel ratio is switched at the time $t_3$. However, there is actually a delay in the decrease of the oxygen storage amount OSA after the target air-fuel ratio is switched. In addition, there is a case where the air-fuel ratio of the exhaust gas flowing into the upstream-side exhaust gas control catalyst 20 is momentarily and substantially deviated from the target air-fuel ratio in an unintended manner, such as a case where an engine load is increased due to acceleration of a vehicle, in which the internal combustion engine is installed, and the intake air amount is momentarily and substantially deviated.

In order to handle such a case, the switching reference storage amount Cref is set sufficiently smaller than the maximum oxygen storable amount Cmax that is obtained when the upstream-side exhaust gas control catalyst 20 is unused. Accordingly, even when the delay as described above occurs, or even when the actual air-fuel ratio of the exhaust gas is momentarily and substantially deviated from the target air-fuel ratio in the unintended manner, the oxygen storage amount OSA does not reach the maximum oxygen storable amount Cmax. Conversely, the switching reference storage amount Cref is set to an amount that is small enough to prevent the oxygen storage amount OSA from reaching the maximum oxygen storable amount Cmax even when the delay as described above or the unintended deviation in the air-fuel ratio occurs. For example, the switching reference storage amount Cref is set to be ¾ or smaller, preferably ½ or smaller, and more preferably ⅕ or smaller of the maximum oxygen storable amount Cmax that is obtained when the upstream-side exhaust gas control catalyst 20 is unused. As a result, the air-fuel ratio correction amount AFC is switched to the rich setting correction amount AFCrich before the output air-fuel ratio AFdwn of the downstream-side air-fuel ratio sensor 41 reaches a lean determination air-fuel ratio AFlean.

When the target air-fuel ratio is switched to the rich air-fuel ratio at the time $t_3$, the air-fuel ratio of the exhaust gas flowing into the upstream-side exhaust gas control catalyst 20 is changed from the lean air-fuel ratio to the rich air-fuel ratio. In conjunction with this, the output air-fuel ratio AFup of the upstream-side air-fuel ratio sensor 40 becomes the rich air-fuel ratio (there is actually the delay in changing of the air-fuel ratio of the exhaust gas flowing into the upstream-side exhaust gas control catalyst 20 after the target air-fuel ratio is switched; however, the delays occur simultaneously in the illustrated example as a matter of convenience). Since the unburned gas is contained in the exhaust gas flowing into the upstream-side exhaust gas control catalyst 20, the oxygen storage amount OSA of the upstream-side exhaust gas control catalyst 20 is gradually decreased. Then, similar to the time $t_1$, the output air-fuel ratio AFdwn of the downstream-side air-fuel ratio sensor 41 starts being lowered at time $t_4$. Since the air-fuel ratio of the exhaust gas flowing into the upstream-side exhaust gas control catalyst 20 remains to be the rich air-fuel ratio at this time, the NOx discharge amount from the upstream-side exhaust gas control catalyst 20 becomes approximately zero.

Next, similar to the time $t_2$, the output air-fuel ratio AFdwn of the downstream-side air-fuel ratio sensor 41 reaches the rich determination air-fuel ratio AFrich at time $t_5$. Accordingly, the air-fuel ratio correction amount AFC is switched to the value AFClean that corresponds to the lean setting air-fuel ratio. Thereafter, the above-described cycle from the time $t_1$ to the time $t_5$ is repeated.

As it can be understood from the above description, according to this embodiment, the NOx discharge amount from the upstream-side exhaust gas control catalyst 20 can be suppressed constantly. In other words, as long as the above-described control is executed, the NOx discharge amount from the upstream-side exhaust gas control catalyst 20 can basically be approximately zero. In addition, since an integration period for calculating the integrated oxygen excess/short amount ΣOED is short, a calculation error is less likely to occur in comparison with a case where the oxygen excess/short amount is integrated for a long period. Thus, NOx discharge caused by the calculation error of the integrated oxygen excess/short amount ΣOED is suppressed.

In general, when the oxygen storage amount of the exhaust gas control catalyst is maintained to be constant, the oxygen storage capacity of the exhaust gas control catalyst is degraded. In other words, in order to maintain the oxygen storage capacity of the exhaust gas control catalyst to be high, the oxygen storage amount of the exhaust gas control catalyst needs to fluctuate. Regarding this, according to this embodiment, as shown in FIG. 5, since the oxygen storage amount OSA of the upstream-side exhaust gas control catalyst 20 constantly fluctuates up and down, the degradation of the oxygen storage capacity is suppressed.

Noted that, in the above embodiment, the air-fuel ratio correction amount AFC is maintained in the lean setting correction amount AFClean from the time $t_2$ to the time $t_3$. However, the air-fuel ratio correction amount AFC does not always have to be maintained to be constant in such a period but may be set to fluctuate, and, for example, may be gradually lowered. Alternatively, in the period from the time $t_2$ to the time $t_3$, the air-fuel ratio correction amount AFC may temporarily be set to a value smaller than zero (for example, the rich setting correction amount or the like). In other words, in the period from the time $t_2$ to the time $t_3$, the target air-fuel ratio may temporarily be set at the rich air-fuel ratio.

Figure 6:
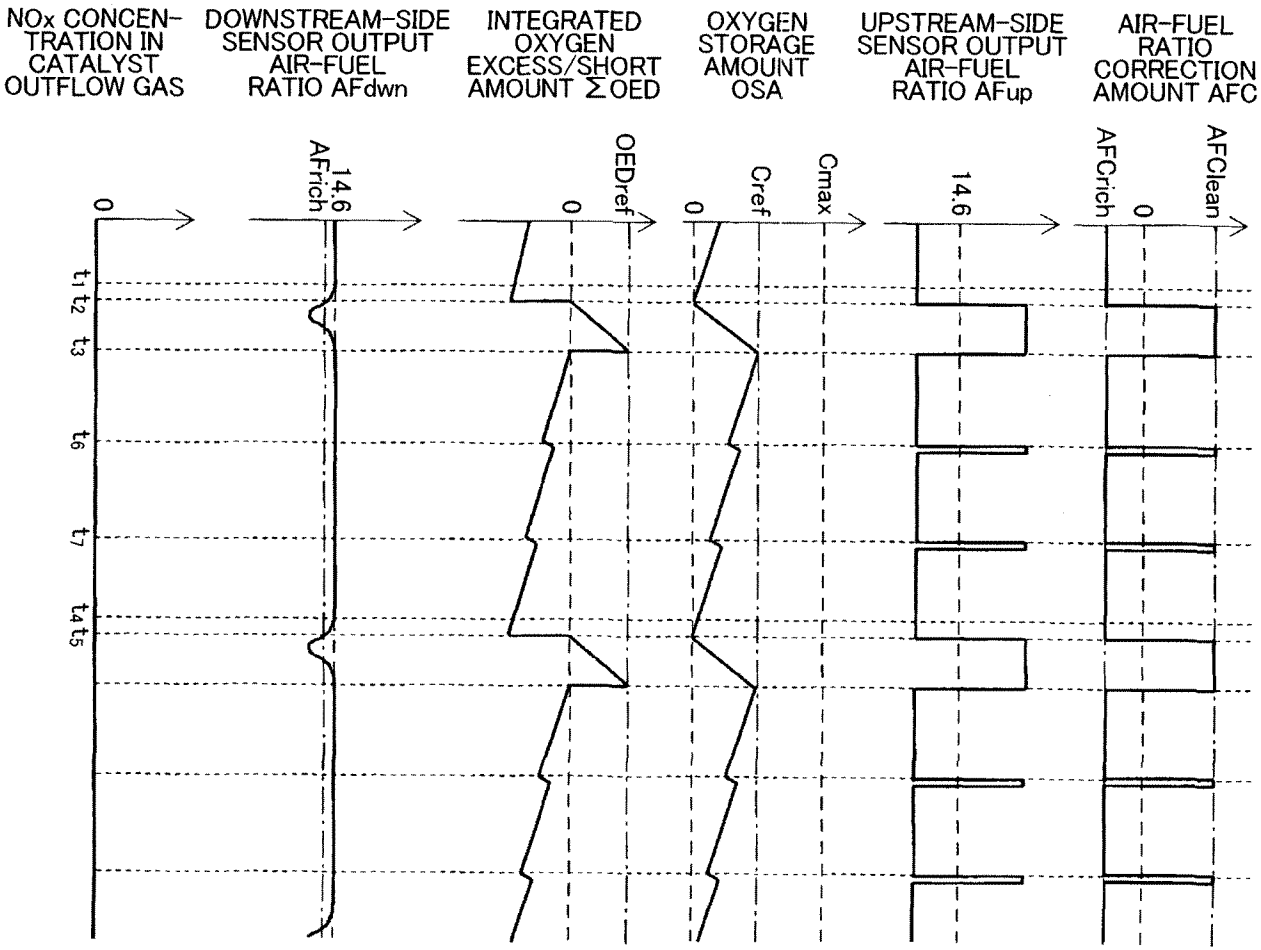
FIG. 6 includes time charts of the air-fuel ratio correction amount and the like when the air-fuel ratio control is executed.

Similarly, in the above embodiment, the air-fuel ratio correction amount AFC is maintained in the rich setting correction amount AFCrich from the time $t_3$ to the time $t_5$. However, the air-fuel ratio correction amount AFC does not always have to be maintained to be constant in such a period but may be set to fluctuate, and, for example, may gradually increase. Alternatively, as shown in FIG. 6, the air-fuel ratio correction amount AFC may temporarily be set to a value larger than zero (for example, the lean setting correction amount or the like) (time $t_6$, $t_7$, and the like in FIG. 6) in the period from the time $t_3$ to the time $t_5$. In other words, in the period from the time $t_3$ to the time $t_5$, the target air-fuel ratio may temporarily be set at the lean air-fuel ratio.

Noted that, even in this case, the air-fuel ratio correction amount AFC from the time $t_2$ to the time $t_3$ is set such that a difference between an average value of the target air-fuel ratio and the theoretical air-fuel ratio in this period becomes larger than a difference between an average value of the target air-fuel ratio and the theoretical air-fuel ratio from the time $t_3$ to the time $t_5$.

Noted that setting of the air-fuel ratio correction amount AFC in this embodiment as described above, that is, setting of the target air-fuel ratio is performed by the ECU 31. Accordingly, it can be said that, when the air-fuel ratio of the exhaust gas detected by the downstream-side air-fuel ratio sensor 41 becomes equal to or lower than the rich determination air-fuel ratio, the ECU 31 continuously or intermittently sets the target air-fuel ratio of the exhaust gas flowing into the upstream-side exhaust gas control catalyst 20 at the lean air-fuel ratio until it is estimated that the oxygen storage amount OSA of the upstream-side exhaust gas control catalyst 20 becomes equal to or larger than the switching reference storage amount Cref. In addition, it can also be said that, when it is estimated that the oxygen storage amount OSA of the upstream-side exhaust gas control catalyst 20 becomes equal to or larger than the switching reference storage amount Cref, the ECU 31 continuously or intermittently sets the target air-fuel ratio at the rich air-fuel ratio until the air-fuel ratio of the exhaust gas detected by the downstream-side air-fuel ratio sensor 41 becomes equal to or lower than the rich determination air-fuel ratio while the oxygen storage amount OSA is prevented from reaching the maximum oxygen storable amount Cmax.

Briefly speaking, in this embodiment, it can be said that the ECU 31 switches the target air-fuel ratio to the lean air-fuel ratio when the air-fuel ratio detected by the downstream-side air-fuel ratio sensor 41 becomes equal to or lower than the rich determination air-fuel ratio and that the ECU 31 switches the target air-fuel ratio to the rich air-fuel ratio when the oxygen storage amount OSA of the upstream-side exhaust gas control catalyst 20 becomes equal to or larger than the switching reference storage amount Cref.

In addition, in the above embodiment, the integrated oxygen excess/short amount ΣOED is calculated on the basis of the output air-fuel ratio AFup of the upstream-side air-fuel ratio sensor 40 as well as the estimated value of the intake air amount to the combustion chamber 5 or the like. However, the oxygen storage amount OSA may be calculated on the basis of another parameter in addition to these parameters or may be calculated on the basis of a parameter that differs from these parameters. Furthermore, in the above embodiment, when the integrated oxygen excess/short amount ΣOED becomes equal to or larger than the switching reference value OEDref, the target air-fuel ratio is switched from the lean setting air-fuel ratio to the rich setting air-fuel ratio. However, timing that the target air-fuel ratio is switched from the lean setting air-fuel ratio to the rich setting air-fuel ratio may be based on another parameter as a reference, such as an engine operation period after the target air-fuel ratio is switched from the rich setting air-fuel ratio to the lean setting air-fuel ratio or an integrated intake air amount. Noted that, also in this case, the target air-fuel ratio has to be switched from the lean setting air-fuel ratio to the rich setting air-fuel ratio while it is estimated that the oxygen storage amount OSA of the upstream-side exhaust gas control catalyst 20 is smaller than the maximum oxygen storable amount.

By the way, when the engine body 1 has the plural cylinders, there is a case where deviations in the air-fuel ratio of the exhaust gas discharged from each of the cylinder occur among the cylinders. Meanwhile, the upstream-side air-fuel ratio sensor 40 is arranged in the aggregated section of the exhaust manifold 19, and depending on an arranged position thereof, a degree of exposure of the exhaust gas discharged from each of the cylinder to the upstream-side air-fuel ratio sensor 40 differs among the cylinders. As a result, the output air-fuel ratio AFup of the upstream-side air-fuel ratio sensor 40 is significantly affected by the air-fuel ratio of the exhaust gas that is discharged from a particular cylinder. Accordingly, when the air-fuel ratio of the exhaust gas discharged from this particular cylinder differs from an average air-fuel ratio of the exhaust gas discharged from all of the cylinders, there is a deviation between the average air-fuel ratio and the output air-fuel ratio AFup of the upstream-side air-fuel ratio sensor 40. In other words, the output air-fuel ratio AFup of the upstream-side air-fuel ratio sensor 40 is deviated to a rich side or a lean side from the actual average air-fuel ratio of the exhaust gas.

In addition, a rate at which hydrogen in the unburned gas passes through a diffusion rate controlling layer of the air-fuel ratio sensor is high. Thus, when a hydrogen concentration in the exhaust gas is high, the output air-fuel ratio AFup of the upstream-side air-fuel ratio sensor 40 is deviated to a lower side (that is, the rich side) than the actual air-fuel ratio of the exhaust gas.

Just as described, when there is the deviation in the output air-fuel ratio AFup of the upstream-side air-fuel ratio sensor 40, there is a case where NOx and oxygen flow out of the upstream-side exhaust gas control catalyst 20 or where an outflow frequency of the unburned gas is increased even with the execution of the control as described above. A description will hereinafter be made on such a phenomenon with reference to FIG. 7 and FIG. 8.

Figure 7:
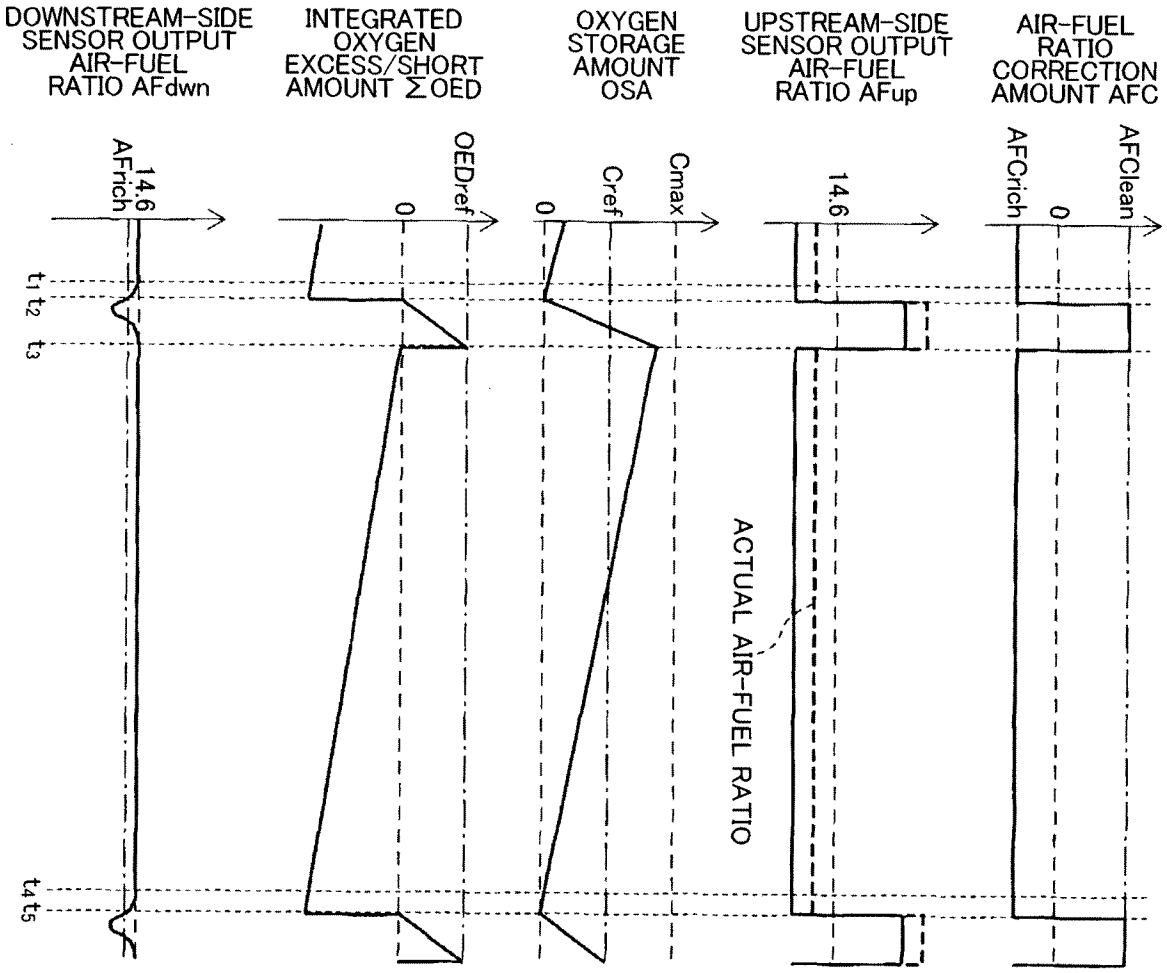
FIG. 7 includes time charts of the air-fuel ratio correction amount and the like when a deviation occurs in an output value of an upstream-side air-fuel ratio sensor.

FIG. 7 includes time charts of the oxygen storage amount OSA of the upstream-side exhaust gas control catalyst 20 and the like that are similar to those in FIG. 5. FIG. 7 shows a case where the output air-fuel ratio AFup of the upstream-side air-fuel ratio sensor 40 is deviated to the rich side. In the chart, a solid line in the output air-fuel ratio AFup of the upstream-side air-fuel ratio sensor 40 indicates the output air-fuel ratio AFup of the upstream-side air-fuel ratio sensor 40. Meanwhile, a broken line indicates an actual air-fuel ratio of the exhaust gas distributed around the upstream-side air-fuel ratio sensor 40.

Also in an example shown in FIG. 7, the air-fuel ratio correction amount AFC is set to the rich setting correction amount AFCrich in the state prior to the time and thus the target air-fuel ratio is set at the rich setting air-fuel ratio. In conjunction with this, the output air-fuel ratio AFup of the upstream-side air-fuel ratio sensor 40 becomes an air-fuel ratio that is equal to the rich setting air-fuel ratio. However, as described above, since the output air-fuel ratio AFup of the upstream-side air-fuel ratio sensor 40 is deviated to the rich side, the actual air-fuel ratio of the exhaust gas is an air-fuel ratio on the leaner side than the rich setting air-fuel ratio. In other words, the output air-fuel ratio AFup of the upstream-side air-fuel ratio sensor 40 is lower than (on the rich side of) the actual air-fuel ratio (the broken line in the chart). Accordingly, a decrease rate of the oxygen storage amount OSA of the upstream-side exhaust gas control catalyst 20 is low.

In addition, in the example shown in FIG. 7, the output air-fuel ratio AFdwn of the downstream-side air-fuel ratio sensor 41 reaches the rich determination air-fuel ratio AFrich at the time $t_2$. Accordingly, as described above, the air-fuel ratio correction amount AFC is switched to the lean setting correction amount AFClean at the time $t_2$. In other words, the target air-fuel ratio is switched to the lean setting air-fuel ratio.

In conjunction with this, the output air-fuel ratio AFup of the upstream-side air-fuel ratio sensor 40 becomes an air-fuel ratio that is equal to the lean setting air-fuel ratio. However, as described above, since the output air-fuel ratio AFup of the upstream-side air-fuel ratio sensor 40 is deviated to the rich side, the actual air-fuel ratio of the exhaust gas is an air-fuel ratio on the leaner side than the lean setting air-fuel ratio. Accordingly, an increase rate of the oxygen storage amount OSA of the upstream-side exhaust gas control catalyst 20 is increased, and an actual oxygen amount that is supplied to the upstream-side exhaust gas control catalyst 20 while the target air-fuel ratio is set at the lean setting air-fuel ratio becomes larger than a switching reference storage amount Cref.

Figure 8:
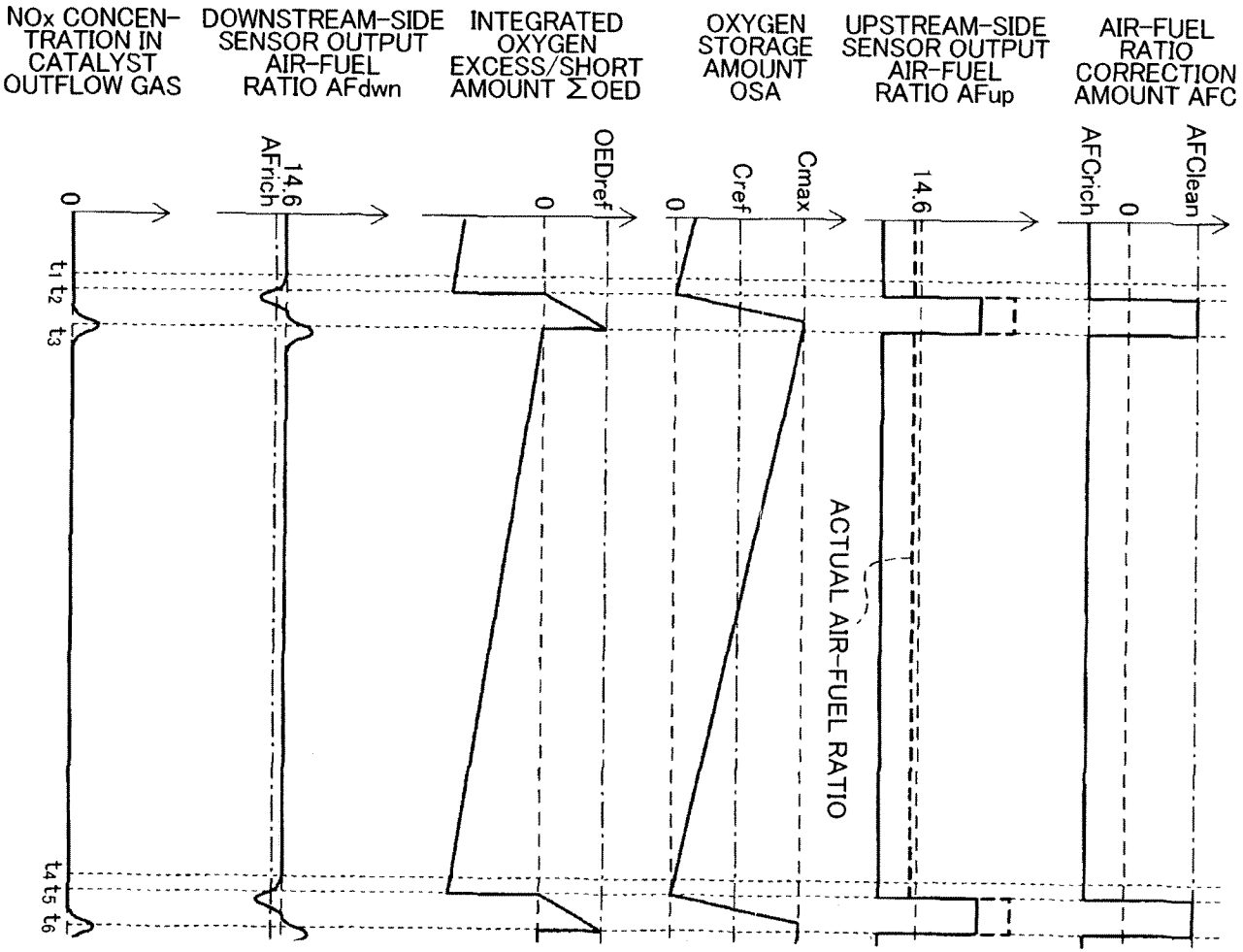
FIG. 8 includes time charts of the air-fuel ratio correction amount and the like when the deviation occurs in the output value of the upstream-side air-fuel ratio sensor.

In addition, when the output air-fuel ratio AFup of the upstream-side air-fuel ratio sensor 40 is significantly deviated, the increase rate of the oxygen storage amount OSA of the upstream-side exhaust gas control catalyst 20 becomes extremely high. Accordingly, in this case, as shown in FIG. 8, the actual oxygen storage amount OSA reaches the maximum oxygen storable amount Cmax before the integrated oxygen excess/short amount ΣOED, which is calculated on the basis of the output air-fuel ratio AFup of the upstream-side air-fuel ratio sensor 40, reaches the switching reference value OEDref. As a result, NOx and oxygen flow out of the upstream-side exhaust gas control catalyst 20.

On the other hand, on the contrary to the above-described example, when the output air-fuel ratio AFup of the upstream-side air-fuel ratio sensor 40 is deviated to a lean side, the increase rate of the oxygen storage amount OSA is lowered, and the decrease rate thereof increased. In this case, a rate at which a cycle from the time $t_2$ to the time $t_5$ is proceeded is increased, and the outflow frequency of the unburned gas from the upstream-side exhaust gas control catalyst 20 is increased.

As described above, it is necessary to detect the deviation in the output air-fuel ratio AFup of the upstream-side air-fuel ratio sensor 40 and to correct the output air-fuel ratio AFup of the upstream-side air-fuel ratio sensor 40 and the like on the basis of the detected deviation.

In view of this, in the embodiment of the invention, leaning control is executed during a normal operation (that is, when the feedback control is executed on the basis of the target air-fuel ratio as described above) in order to compensate for the deviation in the output air-fuel ratio AFup of the upstream-side air-fuel ratio sensor 40. Of the control, normal learning control will be described first.

Here, a period from time at which the target air-fuel ratio is switched to the lean air-fuel ratio to time at which the integrated oxygen excess/short amount ΣOED becomes equal to or larger than the switching reference value OEDref is set as an oxygen increase period (a first period). Similarly, a period from time at which the target air-fuel ratio is switched to the rich air-fuel ratio to time at which the output air-fuel ratio AFdwn of the downstream-side air-fuel ratio sensor 41 becomes equal to or lower than the rich determination air-fuel ratio is set as an oxygen decrease period (a second period). In the normal learning control of this embodiment, a lean oxygen amount integrated value (a first oxygen amount integrated value) is calculated as an absolute value of the integrated oxygen excess/short amount ΣOED in the oxygen increase period. In addition, a rich oxygen amount integrated value (a second oxygen amount integrated value) is calculated as the absolute value of the integrated oxygen excess/short amount ΣOED in the oxygen decrease period. Then, the control center air-fuel ratio AFR is corrected such that a difference between these lean oxygen amount integrated value and rich oxygen amount integrated value is decreased. Such a situation is shown in FIG. 9.

Figure 9:
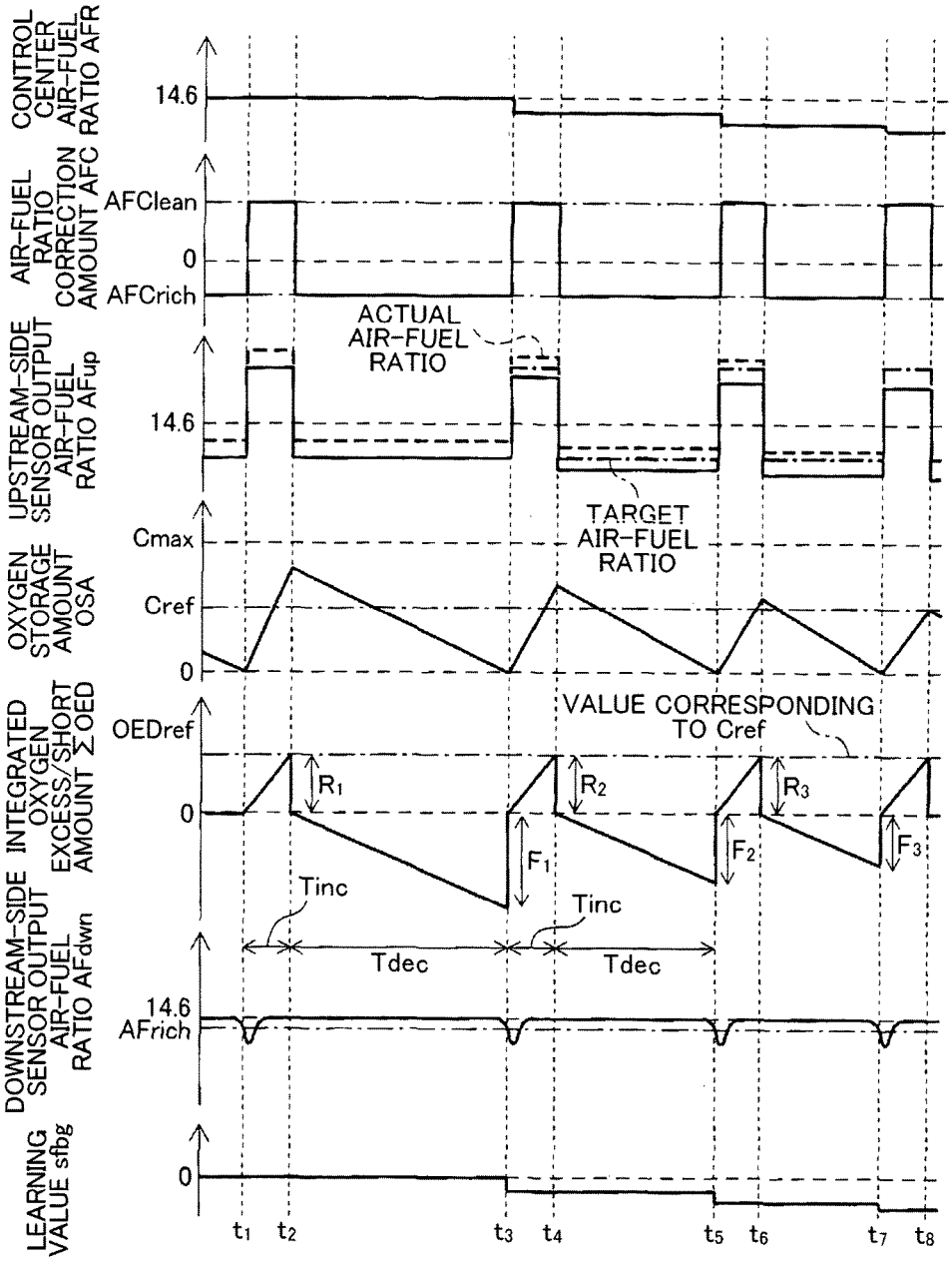
FIG. 9 includes time charts of the air-fuel ratio correction amount and the like when normal learning control is executed.

FIG. 9 includes time charts of the control center air-fuel ratio AFR, the air-fuel ratio correction amount AFC, the output air-fuel ratio AFup of the upstream-side air-fuel ratio sensor 40, the oxygen storage amount OSA of the upstream-side exhaust gas control catalyst 20, the integrated oxygen excess/short amount ΣOED, the output air-fuel ratio AFdwn of the downstream-side air-fuel ratio sensor 41, and a learning value sfbg. Similar to FIG. 7, FIG. 9 shows a case where the output air-fuel ratio AFup of the upstream-side air-fuel ratio sensor 40 is deviated to the lower side (the rich side). Noted that the learning value sfbg is a value that is changed in accordance with the deviation in the output air-fuel ratio AFup of the upstream-side air-fuel ratio sensor 40 (the output current), and is used to correct the control center air-fuel ratio AFR in this embodiment. In the chart, a solid line in the output air-fuel ratio AFup of the upstream-side air-fuel ratio sensor 40 indicates an air-fuel ratio that corresponds to the output detected by the upstream-side air-fuel ratio sensor 40, and a broken line indicates the actual air-fuel ratio of the exhaust gas distributed around the upstream-side air-fuel ratio sensor 40. In addition, a dot and dash line indicates the target air-fuel ratio, that is, an air-fuel ratio corresponding to the air-fuel ratio correction amount AFC.

In an illustrated example, similar to FIG. 5 and FIG. 7, the control center air-fuel ratio is set at the theoretical air-fuel ratio, and the air-fuel ratio correction amount AFC is set to the rich setting correction amount AFCrich in the state prior to the time $t_1$. At this time, the output air-fuel ratio AFup of the upstream-side air-fuel ratio sensor 40 is an air-fuel ratio that corresponds to the rich setting air-fuel ratio as indicated by the solid line. However, since there is the deviation in the output air-fuel ratio AFup of the upstream-side air-fuel ratio sensor 40, the actual air-fuel ratio of the exhaust gas is a leaner air-fuel ratio than the rich setting air-fuel ratio (the broken line in FIG. 9). Here, in the example shown in FIG. 9, as it can be understood from the broken line in FIG. 9, the actual air-fuel ratio of the exhaust gas prior to the time $t_1$ is the rich air-fuel ratio while being leaner than the rich setting air-fuel ratio. Accordingly, the oxygen storage amount of the upstream-side exhaust gas control catalyst 20 is gradually decreased.

At the time $t_1$, the output air-fuel ratio AFdwn of the downstream-side air-fuel ratio sensor 41 reaches the rich determination air-fuel ratio AFrich. Accordingly, as described above, the air-fuel ratio correction amount AFC is switched to the lean setting correction amount AFClean. At the time $t_1$ onward, the output air-fuel ratio AFup of the upstream-side air-fuel ratio sensor 40 becomes an air-fuel ratio that corresponds to the lean setting air-fuel ratio. However, due to the deviation in the output air-fuel ratio AFup of the upstream-side air-fuel ratio sensor 40, the actual air-fuel ratio of the exhaust gas becomes a leaner air-fuel ratio than the lean setting air-fuel ratio, that is, an air-fuel ratio with a higher leanness degree (see the broken line in FIG. 9). Thus, the oxygen storage amount OSA of the upstream-side exhaust gas control catalyst 20 is rapidly increased.

Meanwhile, the oxygen excess/short amount is calculated on the basis of the output air-fuel ratio AFup of the upstream-side air-fuel ratio sensor 40 (more precisely, a difference between the output air-fuel ratio AFup and a basic control center air-fuel ratio (for example, the theoretical air-fuel ratio)). However, as described above, there is the deviation in the output air-fuel ratio AFup of the upstream-side air-fuel ratio sensor 40. Thus, the calculated oxygen excess/short amount becomes a smaller value (that is, a smaller oxygen amount) than the actual oxygen excess/short amount. As a result, the calculated integrated oxygen excess/short amount ΣOED becomes smaller than the actual value.

At the time $t_2$, the integrated oxygen excess/short amount ΣOED reaches the switching reference value OEDref. Accordingly, the air-fuel ratio correction amount AFC is switched to the rich setting correction amount AFCrich. Thus, the target air-fuel ratio is set at the rich air-fuel ratio. At this time, as shown in FIG. 9, the actual oxygen storage amount OSA is larger than the switching reference storage amount Cref.

At the time $t_2$ onward, similar to the state prior to the time $t_1$, the air-fuel ratio correction amount AFC is set to the rich setting correction amount AFCrich, and thus the target air-fuel ratio is set at the rich air-fuel ratio. Also, at this time, the actual air-fuel ratio of the exhaust gas is the leaner air-fuel ratio than the rich setting air-fuel ratio. As a result, the decrease rate of the oxygen storage amount OSA of the upstream-side exhaust gas control catalyst 20 is lowered. In addition, as described above, the actual oxygen storage amount of the upstream-side exhaust gas control catalyst 20 is larger than the switching reference storage amount Cref at the time $t_2$. Accordingly, it takes a long time until the actual oxygen storage amount of the upstream-side exhaust gas control catalyst 20 reaches zero.

At the time $t_3$, the output air-fuel ratio AFdwn of the downstream-side air-fuel ratio sensor 41 reaches the rich determination air-fuel ratio AFrich. Accordingly, as described above, the air-fuel ratio correction amount AFC is switched to the lean setting correction amount AFClean. Thus, the target air-fuel ratio is switched from the rich setting air-fuel ratio to the lean setting air-fuel ratio.

By the way, as described above, the integrated oxygen excess/short amount ΣOED is calculated from the time $t_1$ to the time $t_2$ in this embodiment. Here, a period from time at which the target air-fuel ratio is switched from the rich air-fuel ratio to the lean air-fuel ratio (the time $t_1$) to time at which the target air-fuel ratio is switched from the lean air-fuel ratio to the rich air-fuel ratio (the time $t_2$) is referred to as an oxygen increase period Tinc. In this case, the integrated oxygen excess/short amount ΣOED is calculated in the oxygen increase period Tinc in this embodiment. In FIG. 9, the absolute value of the integrated oxygen excess/short amount ΣOED in the oxygen increase period Tinc from the time $t_1$ to the time $t_2$ is indicated by $R_1$.

The integrated oxygen excess/short amount ΣOED ($R_1$) in this oxygen increase period Tinc corresponds to the oxygen storage amount OSA at the time $t_2$. However, as described above, the oxygen excess/short amount is estimated by using the output air-fuel ratio AFup of the upstream-side air-fuel ratio sensor 40, and there is the deviation in this output air-fuel ratio AFup. Accordingly, in the example shown in FIG. 9, the integrated oxygen excess/short amount ΣOED in the oxygen increase period Tinc from the time $t_1$ to the time $t_2$ is smaller than a value corresponding to the actual oxygen storage amount OSA at the time $t_2$.

In this embodiment, the integrated oxygen excess/short amount ΣOED is also calculated from the time $t_2$ to the time $t_3$. Here, a period from the time at which the target air-fuel ratio is switched from the lean air-fuel ratio to the rich air-fuel ratio (the time $t_2$) to time at which the target air-fuel ratio is switched from the rich air-fuel ratio to the lean air-fuel ratio (the time $t_3$) is referred to as an oxygen decrease period Tdec. In this case, the integrated oxygen excess/short amount ΣOED is calculated in the oxygen decrease period Tdec in this embodiment. In FIG. 9, the absolute value of the integrated oxygen excess/short amount ΣOED in the oxygen decrease period Tdec from the time $t_2$ to the time $t_3$ is indicated by $F_1$.

This integrated oxygen excess/short amount ΣOED ($F_1$) in the oxygen decrease period Tdec corresponds to a total oxygen amount that is released from the upstream-side exhaust gas control catalyst 20 from the time $t_2$ to the time $t_3$. However, as described above, there is the deviation in the output air-fuel ratio AFup of the upstream-side air-fuel ratio sensor 40. Thus, in the example shown in FIG. 9, the integrated oxygen excess/short amount ΣOED in the oxygen decrease period Tdec from the time $t_2$ to the time $t_3$ is larger than a value corresponding to the total oxygen amount that is actually released from the upstream-side exhaust gas control catalyst 20 from the time $t_2$ to the time $t_3$.

Here, oxygen is stored in the upstream-side exhaust gas control catalyst 20 in the oxygen increase period Tinc, and stored oxygen is completely released in the oxygen decrease period Tdec. Accordingly, it is ideal that the absolute value $R_1$ of the integrated oxygen excess/short amount ΣOED in the oxygen increase period Tinc and the absolute value $F_1$ of the integrated oxygen excess/short amount ΣOED in the oxygen decrease period Tdec become basically the same value. However, as described above, when there is the deviation in the output air-fuel ratio AFup of the upstream-side air-fuel ratio sensor 40, the absolute values of these integrated amounts are changed in accordance with this deviation. As described above, when the output air-fuel ratio AFup of the upstream-side air-fuel ratio sensor 40 is deviated to the lower side (the rich side), the absolute value $F_1$ becomes larger than the absolute value $R_1$. On the other hand, when the output air-fuel ratio AFup of the upstream-side air-fuel ratio sensor 40 is deviated to a higher side (the lean side), the absolute value $F_1$ becomes smaller than the absolute value $R_1$. In addition, a difference ΔΣOED between the absolute value $R_1$ of the integrated oxygen excess/short amount ΣOED in the oxygen increase period Tinc and the absolute value $F_1$ of the integrated oxygen excess/short amount ΣOED in the oxygen decrease period Tdec ($=R_1-F_1$, hereinafter referred to as an "excess/short amount error") indicates a degree of the deviation in the output air-fuel ratio AFup of the upstream-side air-fuel ratio sensor 40. It can be said that the deviation in the output air-fuel ratio AFup of the upstream-side air-fuel ratio sensor 40 is larger as the difference between these absolute values $R_1$, $F_1$ is increased.

In view of the above, in this embodiment, the control center air-fuel ratio AFR is corrected on the basis of the excess/short amount error ΔΣOED. In particular, in this embodiment, the control center air-fuel ratio AFR is corrected such that the difference ΔΣOED between the absolute value $R_1$ of the integrated oxygen excess/short amount ΣOED in the oxygen increase period Tinc and the absolute value $F_1$ of the integrated oxygen excess/short amount ΣOED in the oxygen decrease period Tdec is decreased.

More specifically, in this embodiment, the learning value sfbg is calculated by the following equation (2), and the control center air-fuel ratio AFR is corrected by the following equation (3).

$$sfbg(n)=sfbg(n-1)+k_1\cdot A\Sigma OED \quad (2)$$

$$AFR=AFR\text{base}+sfbg(n) \quad (3)$$

Noted that n represents number of calculation or time in the above equation (2). Accordingly, sfbg(n) corresponds to a learning value obtained by the latest calculation or a current learning value. In addition, $k_1$ in the above equation (2) is a gain that represents a degree to which the excess/short amount error ΔΣOED is reflected to the control center air-fuel ratio AFR. A correction amount of the control center air-fuel ratio AFR is increased as a value of the gain $k_1$ is increased. Furthermore, in the above equation (3), the basic control center air-fuel ratio AFRbase is the control center air-fuel ratio that serves as a base and is the theoretical air-fuel ratio in this embodiment.

As described above, at the time $t_3$ in FIG. 9, the learning value sfbg is calculated on the basis of the absolute values $R_1$, $F_1$. In particular, since the absolute value $F_1$ of the integrated oxygen excess/short amount ΣOED in the oxygen decrease period Tdec is larger than the absolute value $R_1$ of the integrated oxygen excess/short amount ΣOED in the oxygen increase period Tinc in the example shown in FIG. 9, the learning value sfbg is decreased at the time $t_3$.

Here, the control center air-fuel ratio AFR is corrected on the basis of the learning value sfbg by using the above equation (3). Since the learning value sfbg is a negative value in the example shown in FIG. 9, the control center air-fuel ratio AFR becomes a value smaller than the basic control center air-fuel ratio AFRbase, that is, a value on the rich side. Accordingly, the air-fuel ratio of the exhaust gas flowing into the upstream-side exhaust gas control catalyst 20 is corrected to the rich side.

As a result, at the time $t_3$ onward, the deviation in the actual air-fuel ratio of the exhaust gas flowing into the upstream-side exhaust gas control catalyst 20 from the target air-fuel ratio becomes smaller than that prior to the time $t_3$. Accordingly, at the time $t_3$ onward, a difference between the broken line indicating the actual air-fuel ratio and a dot and dash line indicating the target air-fuel ratio is smaller than the difference prior to the time $t_3$.

A similar operation as an operation from the time $t_1$ to the time $t_3$ is performed at the time $t_3$ onward. Thus, when the integrated oxygen excess/short amount ΣOED reaches the switching reference value OEDref at the time $t_4$, the target air-fuel ratio is switched from the lean setting air-fuel ratio to the rich setting air-fuel ratio. Thereafter, at the time $t_5$, when the output air-fuel ratio AFdwn of the downstream-side air-fuel ratio sensor 41 reaches the rich determination air-fuel ratio AFrich, the target air-fuel ratio is switched to the lean setting air-fuel ratio again.

As described above, a period from the time $t_3$ to the time $t_4$ corresponds to the oxygen increase period Tinc. Thus, the absolute value of the integrated oxygen excess/short amount ΣOED in this period can be indicated by $R_2$ in FIG. 9. In addition, as described above, a period from the time $t_4$ to the time $t_5$ corresponds to the oxygen decrease period Tdec. Thus, the absolute value of the integrated oxygen excess/short amount ΣOED in this period can be indicated by $F_2$ in FIG. 9. Then, on the basis of the difference ΔΣOED between these absolute values $R_2$, $F_2$ ($=R_2-F_2$), the learning value sfbg is updated by using the above equation (2). In this embodiment, similar control is repeated at the time $t_5$ onward, and the learning value sfbg is thereby repeatedly updated.

The learning value sfbg is updated by the normal leaning control, just as described. Accordingly, while the output air-fuel ratio AFup of the upstream-side air-fuel ratio sensor 40 gradually separates from the target air-fuel ratio, the actual air-fuel ratio of the exhaust gas flowing into the upstream-side exhaust gas control catalyst 20 gradually approaches the target air-fuel ratio. In this way, the deviation in the output air-fuel ratio AFup of the upstream-side air-fuel ratio sensor 40 can be compensated.

In addition, in the above embodiment, the target air-fuel ratio is switched before the oxygen storage amount OSA of the upstream-side exhaust gas control catalyst 20 reaches the maximum oxygen storable amount Cmax. Accordingly, compared to a case where the target air-fuel ratio is switched after the oxygen storage amount OSA reaches the maximum oxygen storable amount Cmax, that is, after the output air-fuel ratio AFdwn of the downstream-side air-fuel ratio sensor 41 becomes equal to or higher than the lean determination air-fuel ratio AFlean, updating frequencies of the learning value sfbg can be increased. Meanwhile, an error tends to occur in the integrated oxygen excess/short amount ΣOED as a calculation period thereof is extended. According to this embodiment, the target air-fuel ratio is switched before the oxygen storage amount OSA reaches the maximum oxygen storable amount Cmax. Thus, the calculation period of the integrated oxygen excess/short amount ΣOED can be shortened. Therefore, occurrence of an error in the calculation of the integrated oxygen excess/short amount ΣOED can be reduced.

Noted that, as described above, the learning value sfbg is preferably updated on the basis of the integrated oxygen excess/short amount ΣOED in the oxygen increase period Tinc and the integrated oxygen excess/short amount ΣOED in the oxygen decrease period Tdec immediately after this oxygen increase period Tinc. It is because, as described above, the total oxygen amount stored in the upstream-side exhaust gas control catalyst 20 in the oxygen increase period Tinc is equal to the total oxygen amount released from the upstream-side exhaust gas control catalyst 20 in the oxygen decrease period Tdec immediately after this oxygen increase period Tinc.

Furthermore, in the above embodiment, the control center air-fuel ratio AFR is corrected on the basis of the learning value sfbg. However, other parameters related to the feedback control may be corrected instead on the basis of the learning value sfbg. As the other parameters, for example, the fuel supply amount to the combustion chamber 5, the output air-fuel ratio AFup of the upstream-side air-fuel ratio sensor 40, an air-fuel ratio correction amount, and the like can be mentioned.

What has been described above is summarized. In this embodiment, when the output air-fuel ratio AFdwn of the downstream-side air-fuel ratio sensor 41 reaches the rich determination air-fuel ratio, the target air-fuel ratio is switched to the lean air-fuel ratio. In addition, when the oxygen storage amount of the upstream-side exhaust gas control catalyst 20 becomes equal to or larger than the specified switching reference storage amount, the target air-fuel ratio is switched to the rich air-fuel ratio. Then, it can be said that, on the basis of the first oxygen amount integrated value that is the absolute value of the integrated oxygen excess/short amount in the first period from the time at which the target air-fuel ratio is switched to the lean air-fuel ratio to the time at which a change amount of the oxygen storage amount becomes equal to or larger than the switching reference storage amount and the second oxygen amount integrated value that is the absolute value of the integrated oxygen excess/short amount in the second period from the time at which the target air-fuel ratio is switched to the rich air-fuel ratio to the time at which the output air-fuel ratio AFdwn of the downstream-side air-fuel ratio sensor 41 becomes equal to or lower than the rich determination air-fuel ratio, learning means executes the normal learning control for correcting the parameter related to the feedback control such that a difference between these first oxygen amount integrated value and second oxygen amount integrated value is decreased.

By the way, as described above, in this embodiment, when the output air-fuel ratio AFdwn of the downstream-side air-fuel ratio sensor 41 becomes equal to or lower than the rich determination air-fuel ratio AFrich, the air-fuel ratio correction amount AFC is switched from the rich setting correction amount AFCrich to the lean setting correction amount AFClean. In conjunction with this, the air-fuel ratio of the exhaust gas flowing into the upstream-side exhaust gas control catalyst 20 is changed from the rich air-fuel ratio to the lean air-fuel ratio. Furthermore, in conjunction with this, oxygen is gradually stored in the upstream-side exhaust gas control catalyst 20.

By the way, according to the inventors of the subject application, it is confirmed that there is a case where the purification of the unburned gas is not progressed in the upstream-side exhaust gas control catalyst 20 despite a fact that the exhaust gas at the lean air-fuel ratio flows into the upstream-side exhaust gas control catalyst 20, just as described, and thus the exhaust gas containing the unburned gas flows out of the upstream-side exhaust gas control catalyst 20 for a while. As a result, despite the fact that the exhaust gas at the lean air-fuel ratio flows into the upstream-side exhaust gas control catalyst 20, the output air-fuel ratio AFdwn of the downstream-side air-fuel ratio sensor 41 is maintained at a lower value than the rich determination air-fuel ratio AFrich. Such a phenomenon tends to occur particularly when the richness degree of the rich air-fuel ratio before the target air-fuel ratio is switched from the rich air-fuel ratio to the lean air-fuel ratio is high.

Here, in many of the internal combustion engines installed in vehicles, fuel cut control for temporarily stopping supply of the fuel to the combustion chamber 5 of the internal combustion engine is executed during actuation of the internal combustion engine. When such fuel cut control is executed, the oxygen storage amount OSA of the upstream-side exhaust gas control catalyst 20 has reached the maximum oxygen storable amount Cmax. Accordingly, in order to retain a NOx purification capacity of the upstream-side exhaust gas control catalyst 20, it is necessary to rapidly decrease the oxygen storage amount OSA of the upstream-side exhaust gas control catalyst 20 after the fuel cut control is terminated. Thus, after the fuel cut control is terminated, as post-restoration rich control, the target air-fuel ratio is set at a post-restoration rich setting air-fuel ratio that has a higher richness degree than the rich setting air-fuel ratio.

When the output air-fuel ratio AFdwn of the downstream-side air-fuel ratio sensor 41 becomes equal to or lower than the rich determination air-fuel ratio AFrich during execution of the post-restoration rich control, the post-restoration rich control is terminated, and the normal air-fuel ratio control is executed. Accordingly, after the post-restoration rich control is terminated, the target air-fuel ratio is switched to the lean air-fuel ratio, that is, the air-fuel ratio correction amount AFC is switched to the lean setting correction amount AFClean. At this time, there is a case where the exhaust gas containing the unburned gas continues to flow out of the upstream-side exhaust gas control catalyst 20 and the output air-fuel ratio AFdwn of the downstream-side air-fuel ratio sensor 41 is maintained to be equal to or lower than the rich determination air-fuel ratio AFrich.

Figure 10:
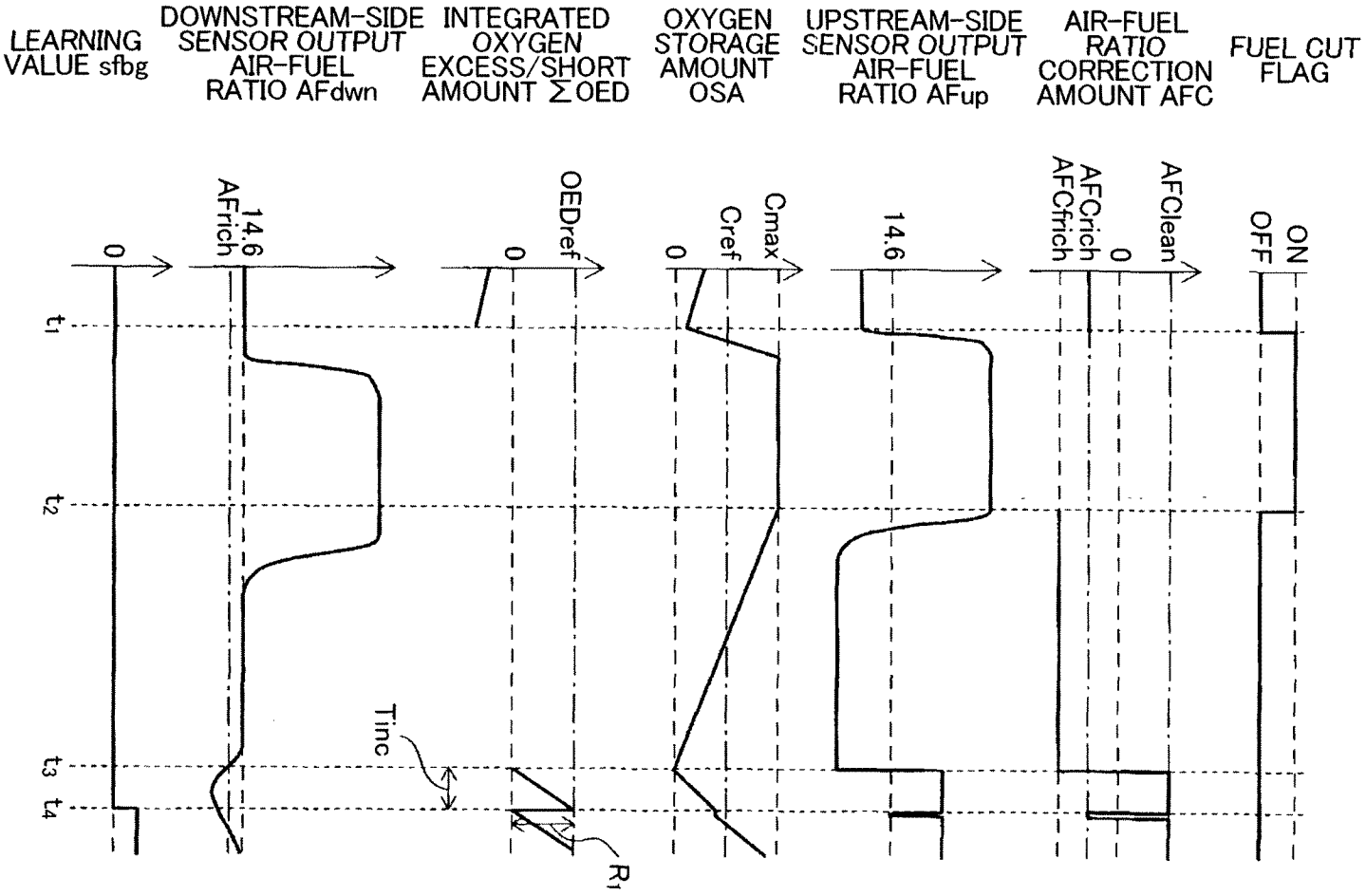
FIG. 10 includes time charts of the air-fuel ratio correction amount and the like when fuel cut control is executed.

Such a situation is shown in FIG. 10. FIG. 10 includes time charts of the air-fuel ratio correction amount AFC and the like when the fuel cut control is executed. In an example shown in FIG. 10, the fuel cut control is initiated at the time $t_1$ due to a decrease in the engine load or the like. Once the fuel cut control is initiated, the air flows out of the combustion chamber 5 of the internal combustion engine. Accordingly, the output air-fuel ratio AFup of the upstream-side air-fuel ratio sensor 40 is rapidly increased. The oxygen storage amount OSA of the upstream-side exhaust gas control catalyst 20 is also rapidly increased.

When the oxygen storage amount OSA of the upstream-side exhaust gas control catalyst 20 reaches the maximum oxygen storable amount Cmax, oxygen that has flown into the upstream-side exhaust gas control catalyst 20 flows out of the upstream-side exhaust gas control catalyst 20 as is. Thus, there is a slight delay in a rapid increase in the output air-fuel ratio AFdwn of the downstream-side air-fuel ratio sensor 41 from the initiation of the fuel cut control.

Then, when the fuel cut control is terminated at the time $t_2$, the post-restoration rich control is initiated. In the post-restoration rich control, the air-fuel ratio correction amount AFC is set to a post-restoration rich correction amount AFCfrich (corresponding to the post-restoration rich setting air-fuel ratio). The post-restoration rich correction amount AFCfrich is a correction amount with a larger absolute value than that of the rich setting correction amount AFCrich. In conjunction with this, the output air-fuel ratio AFup of the upstream-side air-fuel ratio sensor 40 becomes the rich air-fuel ratio (corresponding to the post-restoration rich setting air-fuel ratio). In addition, since the air-fuel ratio of the exhaust gas flowing into the upstream-side exhaust gas control catalyst 20 is also the rich air-fuel ratio with the high richness degree, the oxygen storage amount OSA of the upstream-side exhaust gas control catalyst 20 is rapidly decreased. In addition, since the unburned gas in the exhaust gas flowing into the upstream-side exhaust gas control catalyst 20 is purified in the upstream-side exhaust gas control catalyst 20, the output air-fuel ratio AFdwn of the downstream-side air-fuel ratio sensor 41 is substantially converged to the theoretical air-fuel ratio.

When the oxygen storage amount OSA of the upstream-side exhaust gas control catalyst 20 approaches approximately zero due to the post-restoration rich control, some of the unburned gas flowing into the upstream-side exhaust gas control catalyst 20 is not purified in the upstream-side exhaust gas control catalyst 20 and starts flowing out thereof. As a result, at the time $t_3$, the output air-fuel ratio AFdwn of the downstream-side air-fuel ratio sensor 41 reaches the rich determination air-fuel ratio AFrich. Just as described, when the output air-fuel ratio AFdwn of the downstream-side air-fuel ratio sensor 41 reaches the rich determination air-fuel ratio AFrich, the post-restoration rich control is terminated, and the above-described normal air-fuel ratio control is resumed.

Since the output air-fuel ratio AFdwn of the downstream-side air-fuel ratio sensor 41 is equal to or lower than the rich determination air-fuel ratio AFrich at the time $t_3$, as described above, the air-fuel ratio correction amount AFC is switched to the lean setting correction amount AFClean in the normal air-fuel ratio control. In addition, at this time, the integrated oxygen excess/short amount ΣOED is reset to zero, and the integration is restarted at the time $t_3$.

Thereafter, when the integrated oxygen excess/short amount ΣOED is increased and becomes equal to or larger than the switching reference value OEDref, the air-fuel ratio correction amount AFC is switched to the rich setting correction amount AFCrich at the time $t_4$. Accordingly, the target air-fuel ratio is set at the rich air-fuel ratio, and also at this time, the integrated oxygen excess/short amount ΣOED is reset to zero.

By the way, as described above, in the example shown in FIG. 10, the exhaust gas containing the unburned gas also flows out of the upstream-side exhaust gas control catalyst 20 at the time $t_3$ onward. Accordingly, the output air-fuel ratio AFdwn of the downstream-side air-fuel ratio sensor 41 is maintained to be equal to or lower than the rich determination air-fuel ratio AFrich. Thus, also at the time $t_4$, the output air-fuel ratio AFdwn is equal to or lower than the rich determination air-fuel ratio AFrich. By the way, as described above, in the air-fuel ratio control, in the case where the output air-fuel ratio AFdwn of the downstream-side air-fuel ratio sensor 41 is equal to or lower than the rich determination air-fuel ratio AFrich when the air-fuel ratio correction amount AFC is set to the rich setting correction amount AFCrich, the air-fuel ratio correction amount AFC is switched to the lean setting correction amount AFClean. As a result, in the example shown in FIG. 10, the air-fuel ratio correction amount AFC is switched back to the lean setting correction amount AFClean immediately after being switched from the lean setting correction amount AFClean to the rich setting correction amount AFCrich at the time $t_4$. Thus, in this case, the air-fuel ratio correction amount AFC unnecessarily fluctuates between the rich setting correction amount AFCrich and the lean setting correction amount AFClean in a short time. When such a fluctuation occurs, the exhaust gas containing the unburned gas flows into the upstream-side exhaust gas control catalyst 20 despite the fact that the exhaust gas containing the unburned gas flows out of the upstream-side exhaust gas control catalyst 20. As a result, a period that the exhaust gas containing the unburned gas flows out of the upstream-side exhaust gas control catalyst 20 is extended.

In addition, the target air-fuel ratio is switched from the rich air-fuel ratio to the lean air-fuel ratio at the time $t_3$, and the target air-fuel ratio is switched from the lean air-fuel ratio to the rich air-fuel ratio at the time $t_4$. Accordingly, the period from the time $t_3$ to the time $t_4$ corresponds to the oxygen increase period Tinc, and $R_1$ indicated in FIG. 10 is calculated as the absolute value of the integrated oxygen excess/short amount ΣOED in this period.

On the other hand, the target air-fuel ratio is switched from the lean air-fuel ratio to the rich air-fuel ratio at the time $t_4$, and the target air-fuel ratio is switched from the rich air-fuel ratio to the lean air-fuel ratio immediately after the time $t_4$. Thus, the oxygen decrease period Tdec becomes extremely short. As a result, the absolute value of the integrated oxygen excess/short amount ΣOED ($F_1$, which is not shown) in this period also becomes an extremely small value.

Thus, the excess/short amount error ΔΣOED that is a difference between the absolute value $R_1$ of the integrated oxygen excess/short amount ΣOED in the oxygen increase period Tinc and the absolute value $F_1$ of the integrated oxygen excess/short amount ΣOED in the oxygen decrease period Tdec becomes a large value. For this reason, the learning value sfbg is significantly changed, and the control center air-fuel ratio AFR is also significantly changed by the above-described equation (2).

Meanwhile, as described above, in the example shown in FIG. 10, since the purification of the unburned gas is not progressed in the upstream-side exhaust gas control catalyst 20, the output air-fuel ratio AFdwn of the downstream-side air-fuel ratio sensor 41 is equal to or lower than the rich determination air-fuel ratio AFrich at the time $t_4$. Accordingly, there is no deviation in the output air-fuel ratio AFup of the upstream-side air-fuel ratio sensor 40. However, if the normal learning control as described above is executed, it is determined that there is the deviation in the output air-fuel ratio AFup of the upstream-side air-fuel ratio sensor 40, and thus the learning value sfbg is erroneously changed (erroneous learning).

In view of the above, in this embodiment, in the case where the output air-fuel ratio AFdwn of the downstream-side air-fuel ratio sensor 41 is equal to or lower than the rich determination air-fuel ratio AFrich (that is, remains at the rich air-fuel ratio) when the integrated oxygen excess/short amount ΣOED after switching of the air-fuel ratio correction amount AFC to the lean setting correction amount AFClean becomes equal to or larger than the switching reference value OEDref, the air-fuel ratio correction amount AFC is not switched from the lean setting correction amount AFClean to the rich setting correction amount AFCrich.

Figure 11:
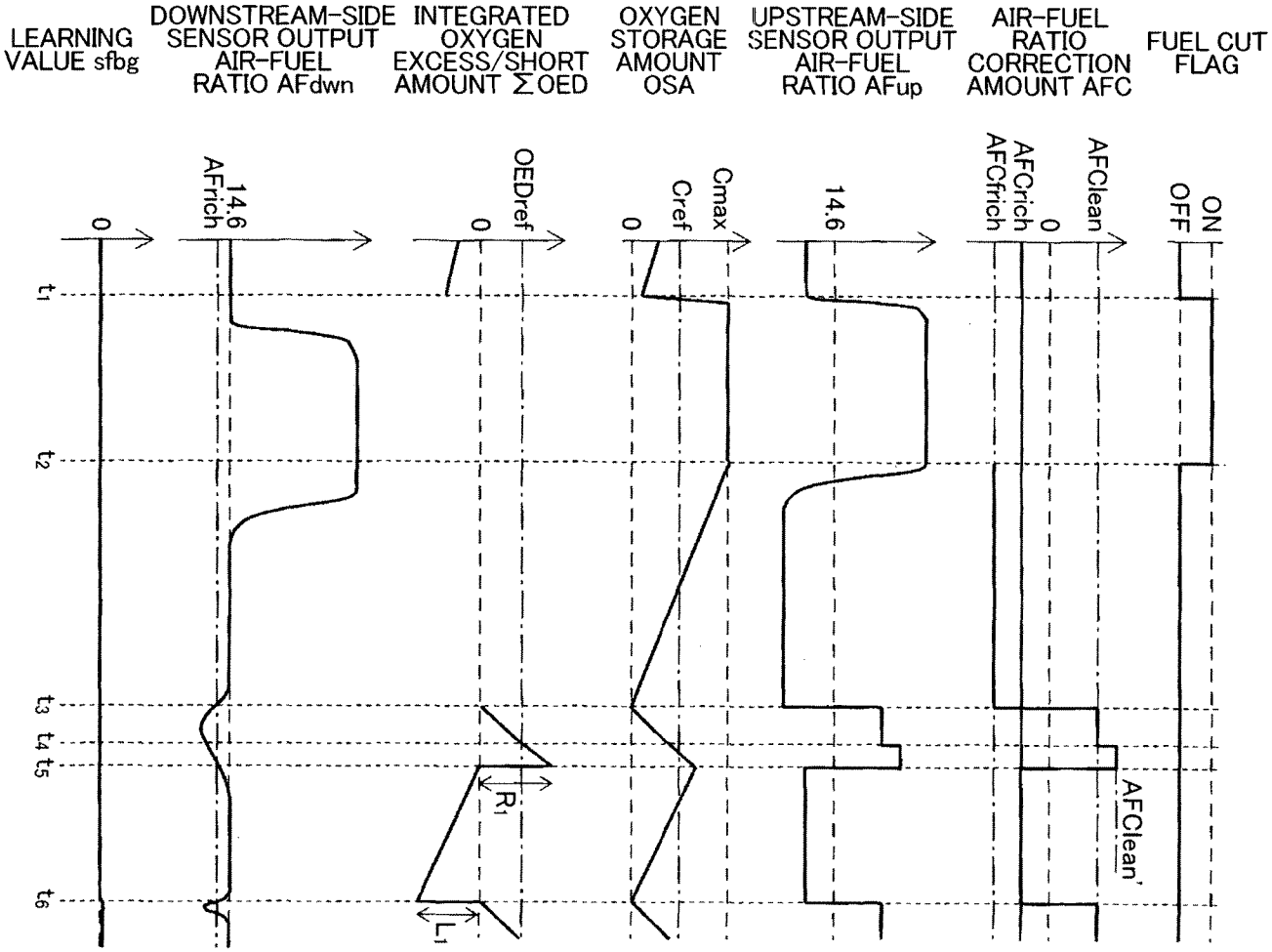
FIG. 11 includes time charts of the air-fuel ratio correction amount and the like when air-fuel ratio control of this embodiment is executed.

FIG. 11 includes time charts of the air-fuel ratio correction amount AFC and the like, which are similar to those in FIG. 10, when the air-fuel ratio control of this embodiment is executed. Also in an example shown in FIG. 11, the fuel cut control is initiated at the time $t_1$ and is terminated at the time $t_2$. In addition, the post-restoration rich control is initiated at the time $t_2$ and is terminated at the time $t_3$.

At the time $t_3$, since the output air-fuel ratio AFdwn of the downstream-side air-fuel ratio sensor 41 is equal to or lower than the rich determination air-fuel ratio AFrich, the air-fuel ratio correction amount AFC is switched to the lean setting correction amount AFClean. Thereafter, at the time $t_4$, the integrated oxygen excess/short amount ΣOED from the time $t_3$ reaches the switching reference value OEDref. However, the output air-fuel ratio AFdwn of the downstream-side air-fuel ratio sensor 41 remains to be equal to or lower than the rich determination air-fuel ratio AFrich at the time $t_4$.

Accordingly, in this embodiment, even when the output air-fuel ratio AFdwn of the downstream-side air-fuel ratio sensor 41 is equal to or lower than the rich determination air-fuel ratio AFrich at the time $t_4$, the air-fuel ratio correction amount AFC is not switched to the rich setting correction amount AFCrich. Conversely, in this embodiment, at the time $t_4$, the air-fuel ratio correction amount AFC is changed to a specified leaner setting correction amount AFClean' that is larger than the lean setting correction amount AFClean. In this way, the unnecessary fluctuation in the air-fuel ratio correction amount AFC between the rich setting correction amount AFCrich and the lean setting correction amount AFClean in the short time is suppressed. In other words, the fluctuation in the target air-fuel ratio between the rich air-fuel ratio and the lean air-fuel ratio in the short time is suppressed.

In the example shown in FIG. 11, thereafter, an outflow amount of the unburned gas from the upstream-side exhaust gas control catalyst 20 is decreased, and in conjunction with this, the output air-fuel ratio AFdwn of the downstream-side air-fuel ratio sensor 41 is gradually increased. Then, at the time $t_5$, the output air-fuel ratio AFdwn of the downstream-side air-fuel ratio sensor 41 becomes a higher air-fuel ratio than the rich determination air-fuel ratio AFrich.

In this embodiment, when the output air-fuel ratio AFdwn of the downstream-side air-fuel ratio sensor 41 becomes higher than the rich determination air-fuel ratio AFrich at the time $t_5$, the air-fuel ratio correction amount AFC is switched from the leaner setting correction amount AFClean' to the rich setting correction amount AFCrich. In other words, the target air-fuel ratio is switched from the lean air-fuel ratio to the rich air-fuel ratio.

Here, at the time $t_5$, the oxygen storage amount OSA of the upstream-side exhaust gas control catalyst 20 is a certain degree of amount. Accordingly, even when the air-fuel ratio correction amount AFC is switched at the time $t_5$, the unburned gas in the exhaust gas flowing into the upstream-side exhaust gas control catalyst 20 is purified in the upstream-side exhaust gas control catalyst 20. Thus, also at the time $t_5$ that the air-fuel ratio correction amount AFC is switched onward, the output air-fuel ratio AFdwn of the downstream-side air-fuel ratio sensor 41 is gradually increased and converged to the theoretical air-fuel ratio.

Meanwhile, since the air-fuel ratio of the exhaust gas flowing into the upstream-side exhaust gas control catalyst 20 is the rich air-fuel ratio at the time $t_5$ onward, the oxygen storage amount OSA of the upstream-side exhaust gas control catalyst 20 is gradually decreased. As a result, the oxygen storage amount OSA of the upstream-side exhaust gas control catalyst 20 reaches approximately zero at the time $t_6$, and in conjunction with this, the output air-fuel ratio AFdwn of the downstream-side air-fuel ratio sensor 41 becomes equal to or lower than the rich determination air-fuel ratio AFrich. Accordingly, as described above, the air-fuel ratio correction amount AFC is switched from the rich setting correction amount AFCrich to the lean setting correction amount AFClean. Thus, the target air-fuel ratio is switched from the rich setting air-fuel ratio to the lean setting air-fuel ratio.

Here, also in the example shown in FIG. 11, the target air-fuel ratio is switched to the lean air-fuel ratio at the time $t_3$, and the target air-fuel ratio is switched to the rich air-fuel ratio at the time $t_5$. Accordingly, a period from the time $t_3$ to the time $t_5$ corresponds to the oxygen increase period Tinc, and $R_1$ indicated in FIG. 11 is calculated as the absolute value of the integrated oxygen excess/short amount ΣOED in this period.

On the other hand, the target air-fuel ratio is switched to the rich air-fuel ratio at the time $t_5$, and the target air-fuel ratio is switched to the lean air-fuel ratio at the time $t_6$. Accordingly, a period from the time $t_5$ to the time $t_6$ corresponds to the oxygen decrease period Tdec, and $L_1$ indicated in FIG. 11 is calculated as the absolute value of the integrated oxygen excess/short amount ΣOED in this period.

As it can be understood from FIG. 11, the absolute value $R_1$ of the integrated oxygen excess/short amount ΣOED in the oxygen increase period Tinc and the absolute value $L_1$ of the integrated oxygen excess/short amount ΣOED in the oxygen decrease period Tdec become a substantially same value. This is because, from the time $t_3$ to the time $t_5$, oxygen in the exhaust gas flowing into the upstream-side exhaust gas control catalyst 20 is stored therein although the purification of the unburned gas is not progressed in the upstream-side exhaust gas control catalyst 20. As a result, the excess/short amount error ΔΣOED that is a difference between $R_1$ and $L_1$ becomes approximately zero, and the learning value sfbg is hardly changed at the time $t_6$. Therefore, according to this embodiment, the erroneous update of the learning value sfbg is suppressed.

Just as described, in this embodiment, the target air-fuel ratio is not switched from the lean air-fuel ratio to the rich air-fuel ratio at the time $t_4$. Accordingly, the unnecessary fluctuation in the target air-fuel ratio between the rich air-fuel ratio and the lean air-fuel ratio in the short time is suppressed. The erroneous update of the learning value is also suppressed.

Noted that, from the time $t_4$ to the time $t_5$ shown in FIG. 11, the air-fuel ratio correction amount AFC is set to the leaner setting correction amount AFClean' that is a predetermined constant value. However, the leaner setting correction amount AFClean' may not be the constant value. For example, the leaner setting correction amount AFClean' may be a value that is defined in accordance with the output air-fuel ratio AFdwn of the downstream-side air-fuel ratio sensor 41 at the time $t_4$. In this case, the leaner setting correction amount AFClean' is set as a constant value from the time $t_4$ to the time $t_5$. Alternatively, the leaner setting correction amount AFClean' may be a value that is changed in accordance with the output air-fuel ratio AFdwn of the downstream-side air-fuel ratio sensor 41 from the time $t_4$ to the time $t_5$. In this case, the leaner setting correction amount AFClean' fluctuates from the time $t_4$ to the time $t_5$.

Figure 12:
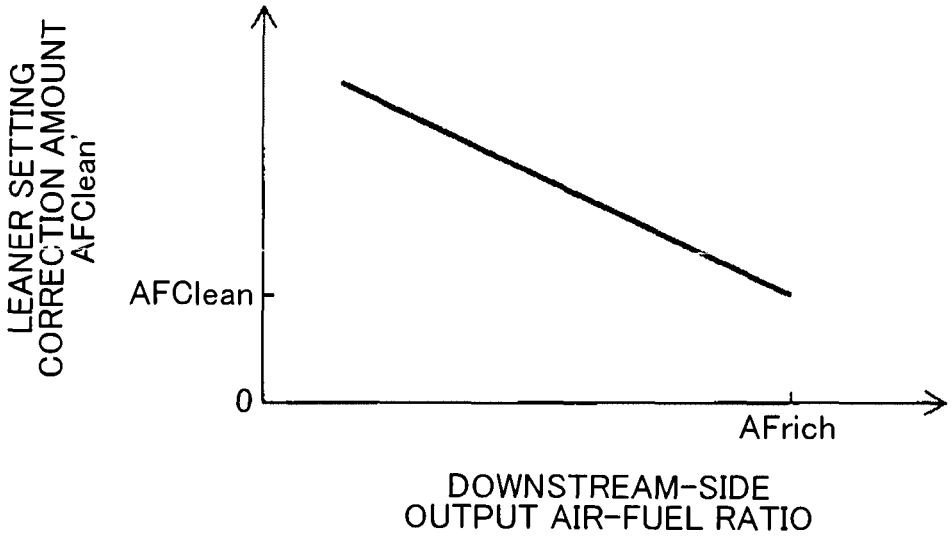
FIG. 12 is a graph for showing a relationship between an output air-fuel ratio of a downstream-side air-fuel ratio sensor and a leaner setting correction amount.

FIG. 12 is a graph for showing a relationship between the output air-fuel ratio AFdwn of the downstream-side air-fuel ratio sensor 41 and the leaner setting correction amount AFClean' when the leaner setting correction amount AFClean' is changed in accordance with the output air-fuel ratio AFdwn. As shown in FIG. 12, the leaner setting correction amount AFClean' is increased as the output air-fuel ratio AFdwn of the downstream-side air-fuel ratio sensor 41 is lowered from the rich determination air-fuel ratio AFrich (the richness degree is increased). Accordingly, especially when progress in the purification of the unburned gas in the upstream-side exhaust gas control catalyst 20 is slow despite the fact that the exhaust gas at the lean air-fuel ratio flows into the upstream-side exhaust gas control catalyst 20, the purification of such unburned gas can be promoted.

In addition, in the above embodiment, the air-fuel ratio correction amount AFC is set to the leaner setting correction amount AFClean' that is larger than the lean setting correction amount AFClean from the time $t_4$ to the time $t_5$ in FIG. 11. In other words, the target air-fuel ratio is set at a leaner setting correction air-fuel ratio with the higher leanness degree than the lean setting air-fuel ratio. However, the air-fuel ratio correction amount AFC may remain at the same value as the lean setting correction amount AFClean from the time $t_4$ to the time $t_5$.

Furthermore, in the above embodiment, at the time $t_4$ onward when the integrated oxygen excess/short amount ΣOED becomes equal to or larger than the switching reference value OEDref and when the output air-fuel ratio AFdwn of the downstream-side air-fuel ratio sensor 41 becomes higher than the rich determination air-fuel ratio AFrich, the air-fuel ratio correction amount AFC is switched from the leaner setting correction amount AFClean' to the rich setting correction amount AFCrich. However, switching timing of the air-fuel ratio correction amount AFC does not always have to be this timing as long as it is timing at which the output air-fuel ratio AFdwn of the downstream-side air-fuel ratio sensor 41 becomes higher than the rich determination air-fuel ratio AFrich onward.

As such switching timing, for example, timing at which the output air-fuel ratio AFdwn of the downstream-side air-fuel ratio sensor 41 becomes an air-fuel ratio that is equal to or higher (has the lower richness degree) than the rich determination air-fuel ratio AFrich can be mentioned. Alternatively, as such switching timing, timing at which the integrated oxygen excess/short amount ΣOED, the integrated intake air amount, or the like becomes a specified amount after the output air-fuel ratio AFdwn of the downstream-side air-fuel ratio sensor 41 becomes higher than the rich determination air-fuel ratio AFrich can be mentioned. Since the air-fuel ratio correction amount AFC is switched at such timing, appropriate switching can be performed even in the case where the output air-fuel ratio AFdwn of the downstream-side air-fuel ratio sensor 41 is increased while fluctuating up and down around the rich determination air-fuel ratio AFrich.

Noted that the above description has been made on the air-fuel ratio control after the post-restoration rich control as the example. However, a situation where the output air-fuel ratio AFdwn of the downstream-side air-fuel ratio sensor 41 remains equal to or lower than the rich determination air-fuel ratio AFrich even when the integrated oxygen excess/short amount ΣOED becomes equal to or larger than the switching reference value OEDref as at the time $t_4$ in FIG. 11 can happen not only in the air-fuel ratio control after the post-restoration rich control but also in the normal air-fuel ratio control. Accordingly, the control of the air-fuel ratio correction amount AFC as described above is not only executed after the post-restoration rich control but also executed in the normal air-fuel ratio control that is executed at time that is not immediately after the post-restoration rich control.

In summary, in this embodiment, the target air-fuel ratio is switched to the lean air-fuel ratio when the output air-fuel ratio AFdwn of the downstream-side air-fuel ratio sensor 41 becomes equal to or lower than the rich determination air-fuel ratio AFrich. When it is estimated that the oxygen storage amount OSA of the upstream-side exhaust gas control catalyst 20 becomes equal to or larger than the specified switching reference storage amount Cref, which is smaller than the maximum oxygen storable amount Cmax, after the target air-fuel ratio is switched to the lean air-fuel ratio, that is, for example, when the integrated oxygen excess/short amount ΣOED becomes equal to or larger than the switching reference value OEDref, the target air-fuel ratio is switched to the rich air-fuel ratio. In addition, in the case where the output air-fuel ratio AFdwn of the downstream-side air-fuel ratio sensor 41 is equal to or lower than the rich determination air-fuel ratio AFrich even when it is estimated that the oxygen storage amount OSA of the upstream-side exhaust gas control catalyst 20 becomes equal to or larger than the switching reference storage amount Cref after the target air-fuel ratio is switched to the lean air-fuel ratio, the target air-fuel ratio is not switched from the lean air-fuel ratio to the rich air-fuel ratio at least until the output air-fuel ratio AFdwn of the downstream-side air-fuel ratio sensor 41 becomes higher than the rich determination air-fuel ratio AFrich.

Figure 13:
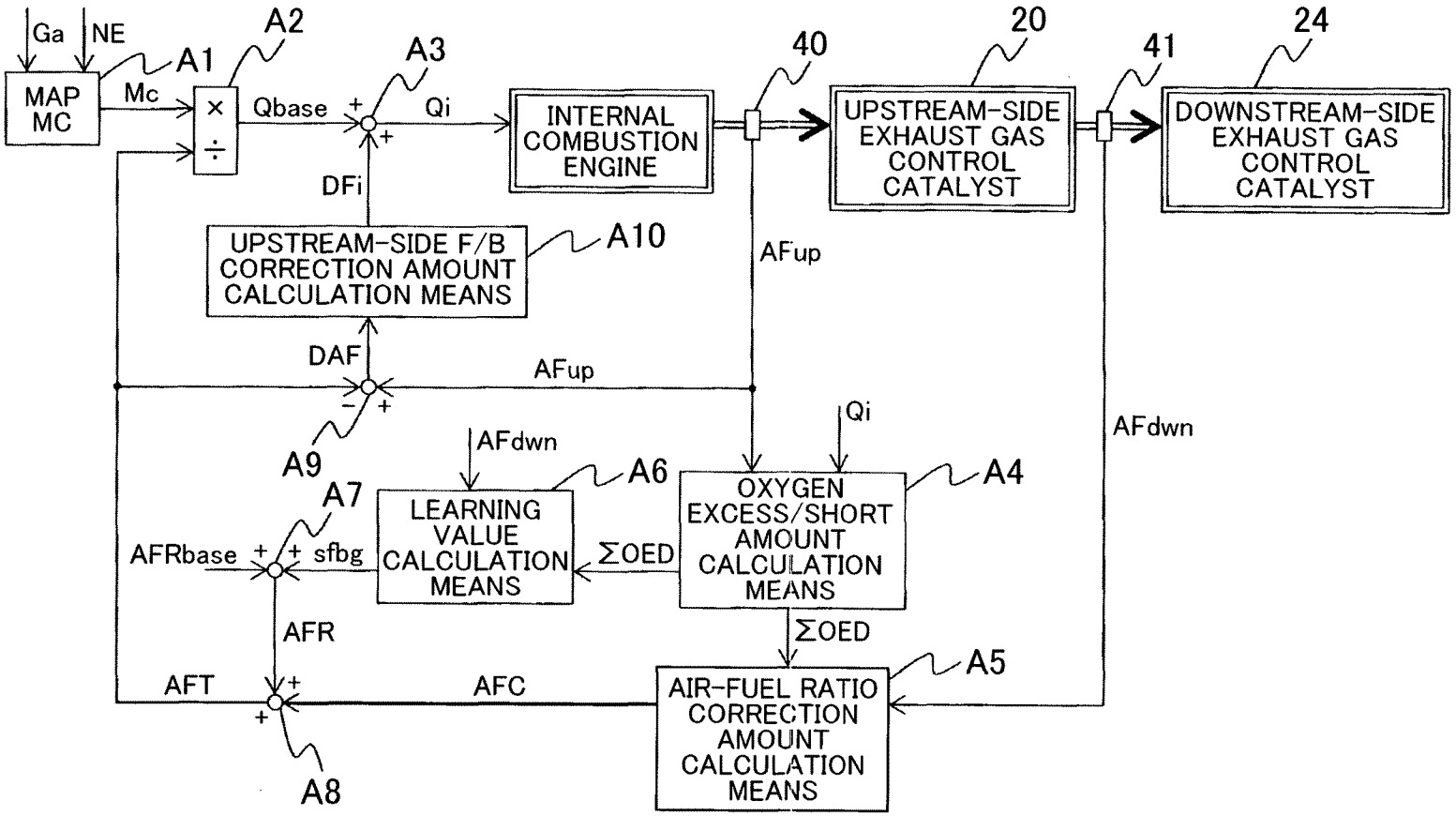
FIG. 13 is a functional block diagram of the control apparatus.

Next, a specific description will be made on the control apparatus in the above embodiment with reference to FIG. 13 to FIG. 15. As shown in FIG. 13 that is a functional block diagram, the control apparatus in this embodiment is configured by including each of functional blocks A1 to A11. A description will hereinafter be made on each of the functional blocks with reference to FIG. 13. The ECU 31 basically performs an operation in each of these functional blocks A1 to A11.

First, calculation of the fuel injection amount will be described. For the calculation of the fuel injection amount, in-cylinder intake air amount calculation means A1, basic fuel injection amount calculation means A2, and fuel injection amount calculation means A3 are used.

The in-cylinder intake air amount calculation means A1 calculates an intake air amount Mc for each of the cylinder on the basis of an intake air flow rate Ga, an engine speed NE, and a map or an equation stored in the ROM 34 of the ECU 31. The intake air flow rate Ga is measured by the airflow meter 39, and the engine speed NE is calculated on the basis of output of the crank angle sensor 44.

The basic fuel injection amount calculation means A2 calculates a basic fuel injection amount Qbase by dividing the in-cylinder intake air amount Mc, which is calculated by the in-cylinder intake air amount calculation means A1, by a target air-fuel ratio AFT (Qbase=Mc/AFT). The target air-fuel ratio AFT is calculated by target air-fuel ratio setting means A8, which will be described below.

The fuel injection amount calculation means A3 calculates a fuel injection amount Qi by adding an F/B correction amount DQi, which will be described below, to the basic fuel injection amount Qbase, which is calculated by the basic fuel injection amount calculation means A2 (Qi=Qbase+DQi). An injection instruction is made for the fuel injection valve 11 such that the fuel in the thus-calculated fuel injection amount Qi is injected from the fuel injection valve 11.

Next, calculation of the target air-fuel ratio will be described. For the calculation of the target air-fuel ratio, oxygen excess/short amount calculation means A4, air-fuel ratio correction amount calculation means A5, learning value calculation means A6, control center air-fuel ratio calculation means A7, and the target air-fuel ratio setting means A8 are used.

The oxygen excess/short amount calculation means A4 calculates the integrated oxygen excess/short amount ΣOED on the basis of the fuel injection amount Qi, which is calculated by the fuel injection amount calculation means A3, and the output air-fuel ratio AFup of the upstream-side air-fuel ratio sensor 40. The oxygen excess/short amount calculation means A4 calculates the integrated oxygen excess/short amount ΣOED, for example, by multiplying a difference between the output air-fuel ratio AFup of the upstream-side air-fuel ratio sensor 40 and the control center air-fuel ratio AFR by the fuel injection amount Qi and integrating an obtained value.

The air-fuel ratio correction amount calculation means A5 calculates the air-fuel ratio correction amount AFC of the target air-fuel ratio on the basis of the integrated oxygen excess/short amount ΣOED, which is calculated by the oxygen excess/short amount calculation means A4, and the output air-fuel ratio AFdwn of the downstream-side air-fuel ratio sensor 41. More specifically, the air-fuel ratio correction amount AFC is calculated on the basis of a flowchart shown in FIG. 14.

The learning value calculation means A6 calculates the learning value sfbg on the basis of the output air-fuel ratio AFdwn of the downstream-side air-fuel ratio sensor 41, the integrated oxygen excess/short amount ΣOED, which is calculated by the oxygen excess/short amount calculation means A4, and the like. More specifically, the learning value sfbg is calculated on the basis of a flowchart of the normal learning control shown in FIG. 15. The thus-calculated learning value sfbg is stored in a storage medium in the RAM 33 of the ECU 31, from which the learning value sfbg is not deleted even when an ignition key of the vehicle, in which the internal combustion engine is installed, is turned off.

The control center air-fuel ratio calculation means A7 calculates the control center air-fuel ratio AFR on the basis of the basic control center air-fuel ratio AFRbase (for example, the theoretical air-fuel ratio) and the learning value sfbg, which is calculated by the learning value calculation means A6. More specifically, as indicated by the above-described equation (3), the control center air-fuel ratio AFR is calculated by adding the learning value sfbg to the basic control center air-fuel ratio AFRbase.

The target air-fuel ratio setting means A8 calculates the target air-fuel ratio AFT by adding the air-fuel ratio correction amount AFC, which is calculated by the air-fuel ratio correction amount calculation means A5, to the control center air-fuel ratio AFR, which is calculated by the control center air-fuel ratio calculation means A7. The thus-calculated target air-fuel ratio AFT is input to the basic fuel injection amount calculation means A2 and air-fuel ratio deviation calculation means A9, which will be described below.

Next, calculation of an F/B correction amount on the basis of the output air-fuel ratio AFup of the upstream-side air-fuel ratio sensor 40 will be described. For the calculation of the F/B correction amount, the air-fuel ratio deviation calculation means A9 and an upstream-side F/B correction amount calculation means A10 are used.

The air-fuel ratio deviation calculation means A9 calculates an air-fuel ratio deviation DAF by subtracting the target air-fuel ratio AFT, which is calculated by the target air-fuel ratio setting means A8, from the output air-fuel ratio AFup of the upstream-side air-fuel ratio sensor 40 (DAF=AFup−AFT). This air-fuel ratio deviation DAF is a value that indicates excess/shortage of the fuel supply amount with respect to the target air-fuel ratio AFT.

The upstream-side F/B correction amount calculation means A10 calculates an F/B correction amount DFi for compensating the excess/shortage of the fuel supply amount on the basis of the following equation (4) by performing proportional-integral-derivative processing (PID processing) on the air-fuel ratio deviation DAF, which is calculated by the air-fuel ratio deviation calculation means A9. The thus-calculated F/B correction amount DFi is input to the fuel injection amount calculation means A3.

$$DFi=Kp-DAF+Ki\cdot SDAF+Kd\cdot DDAF \quad (4)$$

Noted that, in the above equation (4), Kp is a predetermined proportional gain (a proportional constant), Ki is a predetermined integral gain (an integral constant), and Kd is a predetermined derivative gain (a derivative constant). In addition, DDAF is a time derivative value of the air-fuel ratio deviation DAF and is calculated by dividing a deviation between the currently updated air-fuel ratio deviation DAF and the previously updated air-fuel ratio deviation DAF by time corresponding to an update interval. Furthermore, SDAF is a time integral value of the air-fuel ratio deviation DAF, and this time integral value SDAF is calculated by adding the currently updated air-fuel ratio deviation DAF to the previously updated time derivative value DDAF (SDAF=DDAF+DAF).

Figure 14:
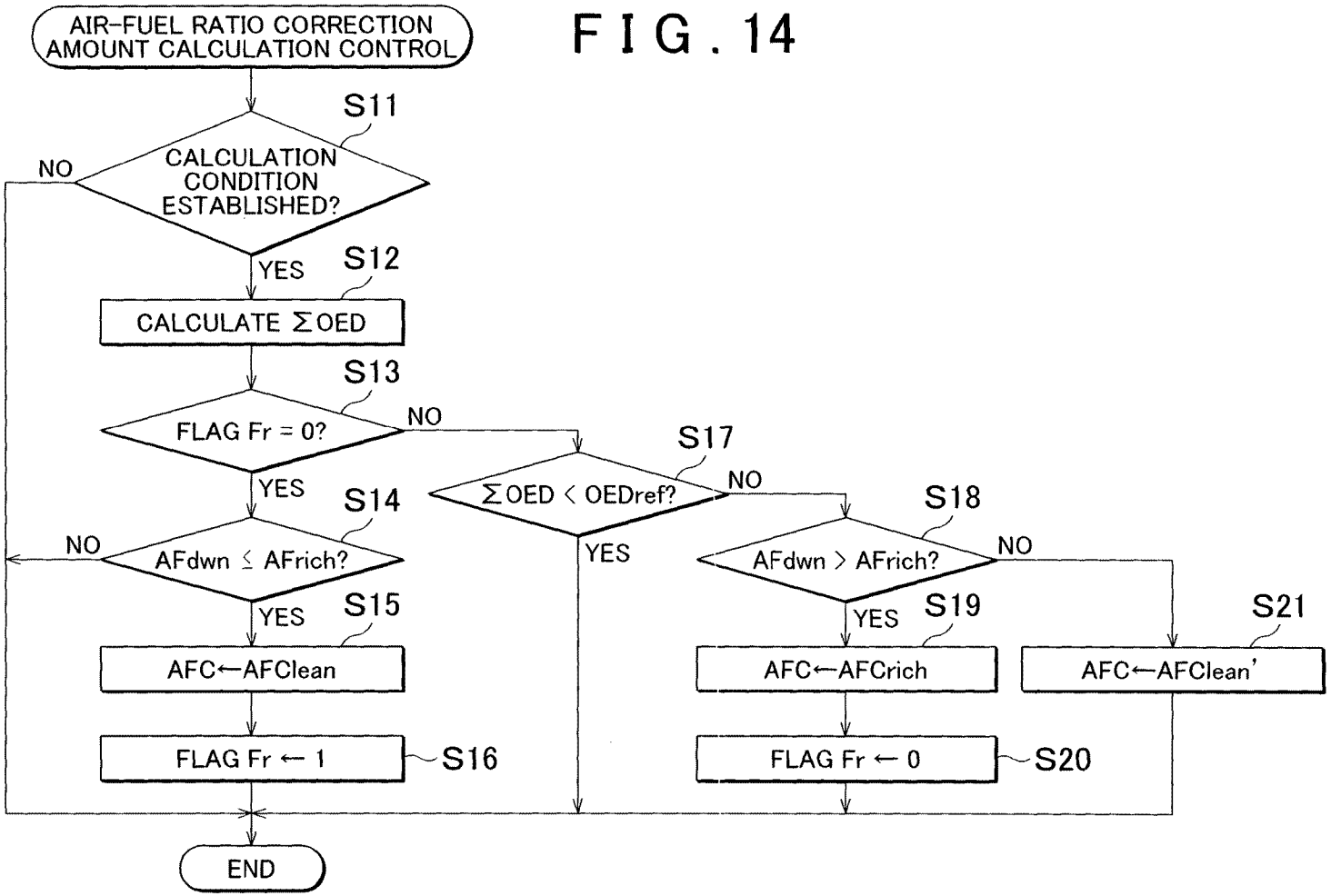
FIG. 14 is a flowchart of a control routine of calculation control of the air-fuel ratio correction amount.

FIG. 14 is a flowchart of calculation control of the air-fuel ratio correction amount AFC, that is, a control routine of the air-fuel ratio control. The illustrated control routine is performed by interruptions at fixed time intervals.

As shown in FIG. 14, it is first determined in step S11 whether a calculation condition of the air-fuel ratio correction amount AFC is established. As a case where the calculation condition of the air-fuel ratio correction amount AFC is established, a case during the normal control in which the feedback control is executed, such as a case where the fuel cut control, the post-restoration rich control, or the like is not currently executed, can be mentioned. If it is determined in step S11 that the calculation condition of the air-fuel ratio correction amount AFC is established, the process proceeds to step S12. In step S12, the integrated oxygen excess/short amount ΣOED is calculated on the basis of the output air-fuel ratio AFup of the upstream-side air-fuel ratio sensor 40 and the fuel injection amount Qi.

Next, it is determined in step S13 whether a lean setting flag Fr is set to 0. The lean setting flag Fr is set to 1 when the air-fuel ratio correction amount AFC is set to the lean setting correction amount AFClean. Except for the above, the lean setting flag Fr is set to 0. If the lean setting flag Fr is set to 0 in step S13, the process proceeds to step S14. In step S14, it is determined whether the output air-fuel ratio AFdwn of the downstream-side air-fuel ratio sensor 41 is equal to or lower than the rich determination air-fuel ratio AFrich. If it is determined that the output air-fuel ratio AFdwn of the downstream-side air-fuel ratio sensor 41 is higher than the rich determination air-fuel ratio AFrich, the control routine is terminated.

On the other hand, when the oxygen storage amount OSA of the upstream-side exhaust gas control catalyst 20 is decreased and the air-fuel ratio of the exhaust gas flowing out of the upstream-side exhaust gas control catalyst 20 is lowered, it is determined in step S14 that the output air-fuel ratio AFdwn of the downstream-side air-fuel ratio sensor 41 is equal to or lower than the rich determination air-fuel ratio AFrich. In this case, the process proceeds to step S15, and the air-fuel ratio correction amount AFC is set to the lean setting correction amount AFClean. Next, in step S16, the lean setting flag Fr is set to 1, and the control routine is then terminated.

In the next control routine, it is determined in step S13 that the lean setting flag Fr is not set to zero, and the process proceeds to step S17. In step S17, it is determined whether the integrated oxygen excess/short amount ΣOED, which is calculated in step S12, is smaller than the switching reference value OEDref. If it is determined that the integrated oxygen excess/short amount ΣOED is smaller than the switching reference value OEDref, the air-fuel ratio correction amount AFC remains to be the lean setting correction amount AFClean, and the control routine is then terminated.

Meanwhile, when the oxygen storage amount OSA of the upstream-side exhaust gas control catalyst 20 is increased, it is eventually determined in step S17 that the integrated oxygen excess/short amount ΣOED is equal to or larger than the switching reference value OEDref. Then, the process proceeds to step S18. In step S18, it is determined whether the output air-fuel ratio AFdwn of the downstream-side air-fuel ratio sensor 41 is higher than the rich determination air-fuel ratio AFrich. If it is determined that the output air-fuel ratio AFdwn of the downstream-side air-fuel ratio sensor 41 is higher than the rich determination air-fuel ratio AFrich, the process proceeds to step S19. In step S19, the air-fuel ratio correction amount AFC is set to the rich setting correction amount AFCrich. Next, in step S20, the lean setting flag Fr is reset to 0, and the control routine is then terminated.

On the other hand, if it is determined in step S18 that the output air-fuel ratio AFdwn of the downstream-side air-fuel ratio sensor 41 is equal to or higher than the rich determination air-fuel ratio AFrich, the process proceeds to step S21. In step S21, the air-fuel ratio correction amount AFC is set to the leaner setting correction amount AFClean', and the control routine is then terminated.

Figure 15:
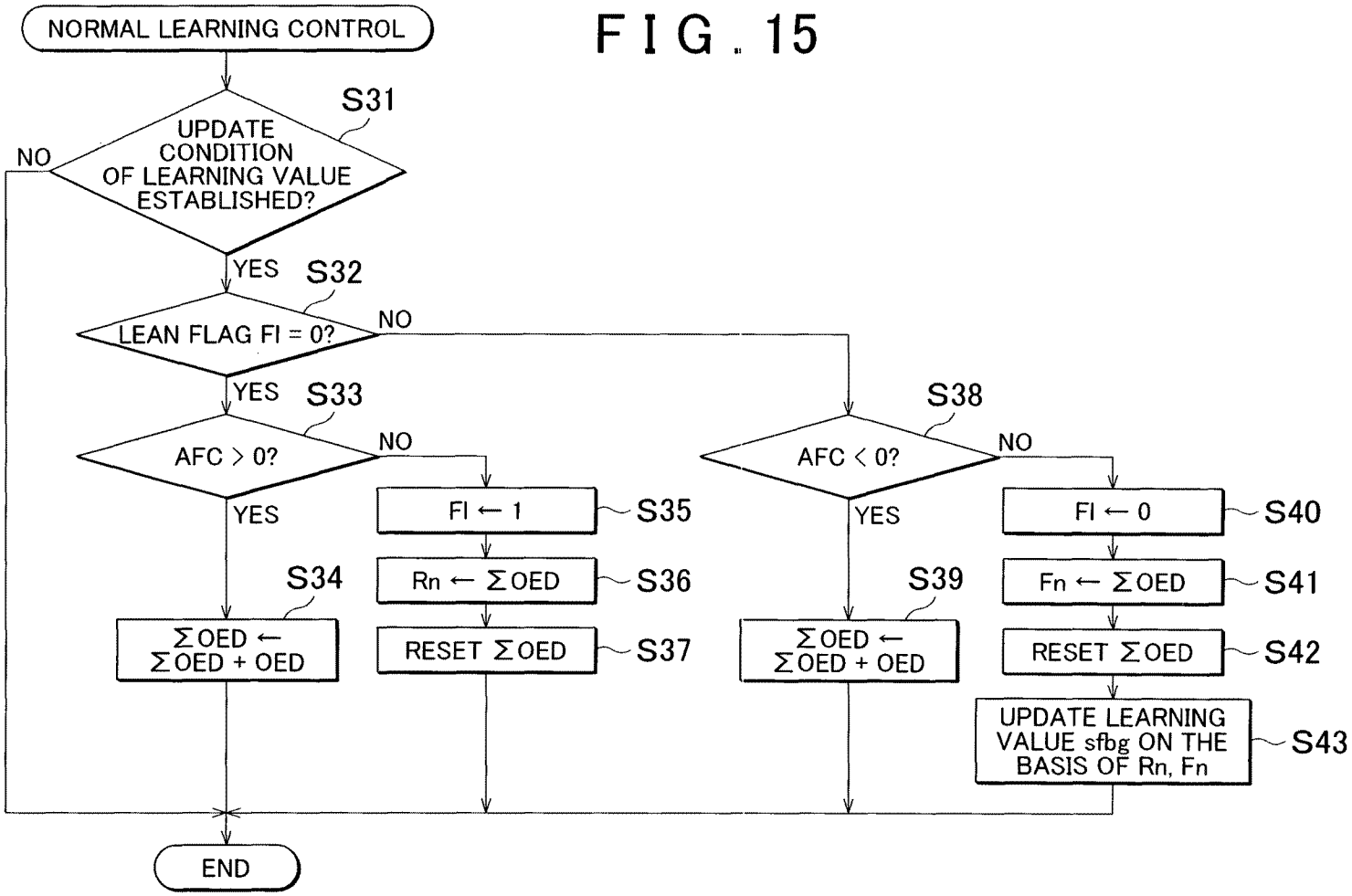
FIG. 15 is a flowchart of a control routine of the normal learning control.

FIG. 15 is a flowchart of a control routine of the normal learning control. The illustrated control routine is performed by interruptions at fixed time intervals.

As shown in FIG. 15, it is first determined in step S31 whether an update condition of the learning value sfbg is established. As a case where the update condition is established, for example, a case during the normal control, and the like can be mentioned. If it is determined in step S31 that the update condition of the learning value sfbg is established, the process proceeds to step S32. In step S32, it is determined whether a lean flag F1 is set to 0. If it is determined in step S32 that the lean flag F1 is set to 0, the process proceeds to step S33.

In step S33, it is determined whether the air-fuel ratio correction amount AFC is larger than zero, that is, whether the target air-fuel ratio is the lean air-fuel ratio. If it is determined in step S33 that the air-fuel ratio correction amount AFC is larger than zero, the process proceeds to step S34. In step S34, the current oxygen excess/short amount OED is added to the integrated oxygen excess/short amount ΣOED.

Then, once the target air-fuel ratio is switched to the rich air-fuel ratio, in the next routine, it is determined in step S33 that the air-fuel ratio correction amount AFC is equal to or smaller than zero, and the process proceeds to step S35. In step S35, the lean flag F1 is set to 1, and next in step S36, Rn is set as the absolute value of the current integrated oxygen excess/short amount ΣOED. Next, in step S37, the integrated oxygen excess/short amount ΣOED is reset to zero, and the control routine is then terminated.

Meanwhile, once the lean flag F1 is set to 1, in the next routine, the process proceeds from step S32 to step S38. In step S38, it is determined whether the air-fuel ratio correction amount AFC is smaller than zero, that is, whether the target air-fuel ratio is the rich air-fuel ratio. If it is determined in step S38 that the air-fuel ratio correction amount AFC is smaller than zero, the process proceeds to step S39. In step S39, the current oxygen excess/short amount OED is added to the integrated oxygen excess/short amount ΣOED.

Then, once the target air-fuel ratio is switched to the lean air-fuel ratio, in the next control routine, it is determined in step S38 that the air-fuel ratio correction amount AFC is equal to or larger than zero, and the process proceeds to step S40. In step S40, the lean flag F1 is set to 0, and next in step S41, Fn is set as the absolute value of the current integrated oxygen excess/short amount ΣOED. Next, in step S42, the integrated oxygen excess/short amount ΣOED is reset to zero. Next, in step S43, the learning value sfbg is updated on the basis of Rn, which is calculated in step S36, and Fn, which is calculated in step S41, and the control routine is then terminated.

Next, a description will be made on a control apparatus according to a second embodiment of the invention with reference to FIG. 16 to FIG. 18. A configuration of and control by the control apparatus according to the second embodiment are basically the same as the configuration of and the control by the control apparatus according to the first embodiment except for control described below.

By the way, in the example shown in FIG. 7 and FIG. 8, there is the deviation in the output air-fuel ratio AFup of the upstream-side air-fuel ratio sensor 40; however, a degree of the deviation is not significant. Thus, as it can be understood from the broken lines in FIG. 7 and FIG. 8, when the target air-fuel ratio is set at the rich setting air-fuel ratio, the actual air-fuel ratio of the exhaust gas is the rich air-fuel ratio that is leaner than the rich setting air-fuel ratio.

On the other hand, if the deviation in the upstream-side air-fuel ratio sensor 40 becomes significant, the actual air-fuel ratio of the exhaust gas may become the rich air-fuel ratio despite the fact that the target air-fuel ratio is set at the lean setting air-fuel ratio. Such a situation is shown in FIG. 16.

Figure 16:
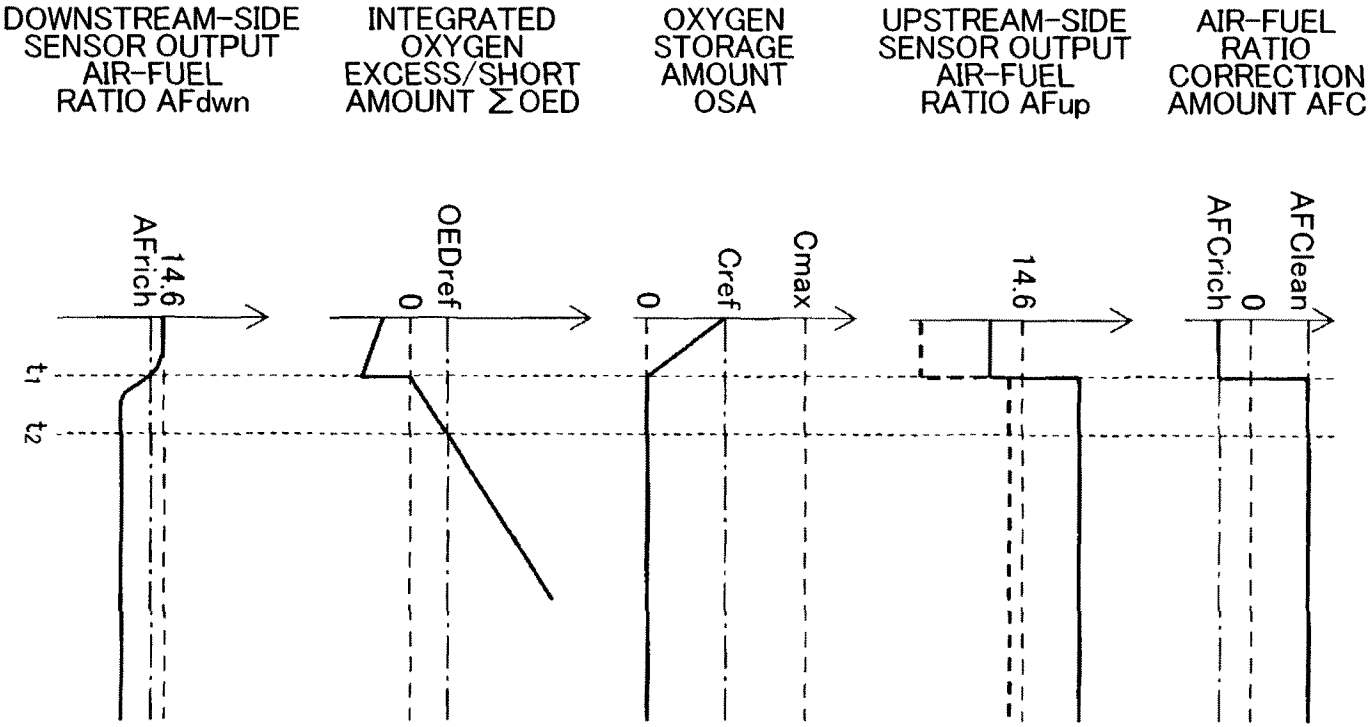
FIG. 16 includes time charts of the air-fuel ratio correction amount and the like when a large fluctuation occurs in the upstream-side air-fuel ratio sensor.

In FIG. 16, the air-fuel ratio correction amount AFC is set to the rich setting correction amount AFCrich prior to the time $t_1$. In conjunction with this, the output air-fuel ratio AFup of the upstream-side air-fuel ratio sensor 40 becomes the rich setting air-fuel ratio. However, since the output air-fuel ratio AFup of the upstream-side air-fuel ratio sensor 40 is significantly deviated to the lean side, the actual air-fuel ratio of the exhaust gas is an air-fuel ratio that is richer than the rich setting air-fuel ratio (a broken line in the chart).

Thereafter, when the output air-fuel ratio AFdwn of the downstream-side air-fuel ratio sensor 41 reaches the rich determination air-fuel ratio AFrich at the time $t_1$, the air-fuel ratio correction amount AFC is switched to the lean setting correction amount AFClean. In conjunction with this, the output air-fuel ratio AFup of the upstream-side air-fuel ratio sensor 40 becomes an air-fuel ratio that corresponds to the lean setting air-fuel ratio. However, since the output air-fuel ratio AFup of the upstream-side air-fuel ratio sensor 40 is significantly deviated to the lean side, the actual air-fuel ratio of the exhaust gas is the rich air-fuel ratio (the broken line in the chart).

As a result, despite the fact that the air-fuel ratio correction amount AFC is set to the lean setting correction amount AFClean, the exhaust gas at the rich air-fuel ratio flows into the upstream-side exhaust gas control catalyst 20. Accordingly, the oxygen storage amount OSA of the upstream-side exhaust gas control catalyst 20 is maintained to be zero. Thus, the unburned gas contained in the inflow exhaust gas flows out of the upstream-side exhaust gas control catalyst 20 as is. Consequently, the output air-fuel ratio AFdwn of the downstream-side air-fuel ratio sensor 41 is maintained to be lower than the rich determination air-fuel ratio AFrich.

In the case where the air-fuel ratio control according to the first embodiment is executed in a state that the output air-fuel ratio AFdwn of the downstream-side air-fuel ratio sensor 41 is maintained to be lower than the rich determination air-fuel ratio AFrich, just as described, the air-fuel ratio correction amount AFC is maintained in the lean setting correction amount AFClean as shown in FIG. 16 even when the integrated oxygen excess/short amount ΣOED reaches the switching reference value OEDref at the time $t_2$. In addition, the learning value sfbg is not updated. As a result, the exhaust gas containing the unburned gas continues to flow out of the upstream-side exhaust gas control catalyst 20.

In view of the above, in this second embodiment, in the case where the output air-fuel ratio AFdwn of the downstream-side air-fuel ratio sensor 41 is maintained at the rich determination air-fuel ratio AFrich for a long time even after the integrated oxygen excess/short amount ΣOED reaches the switching reference value OEDref, the learning value sfbg is updated such that the air-fuel ratio of the exhaust gas flowing into the upstream-side exhaust gas control catalyst 20 is changed to be on the leaner side.

Figure 17:
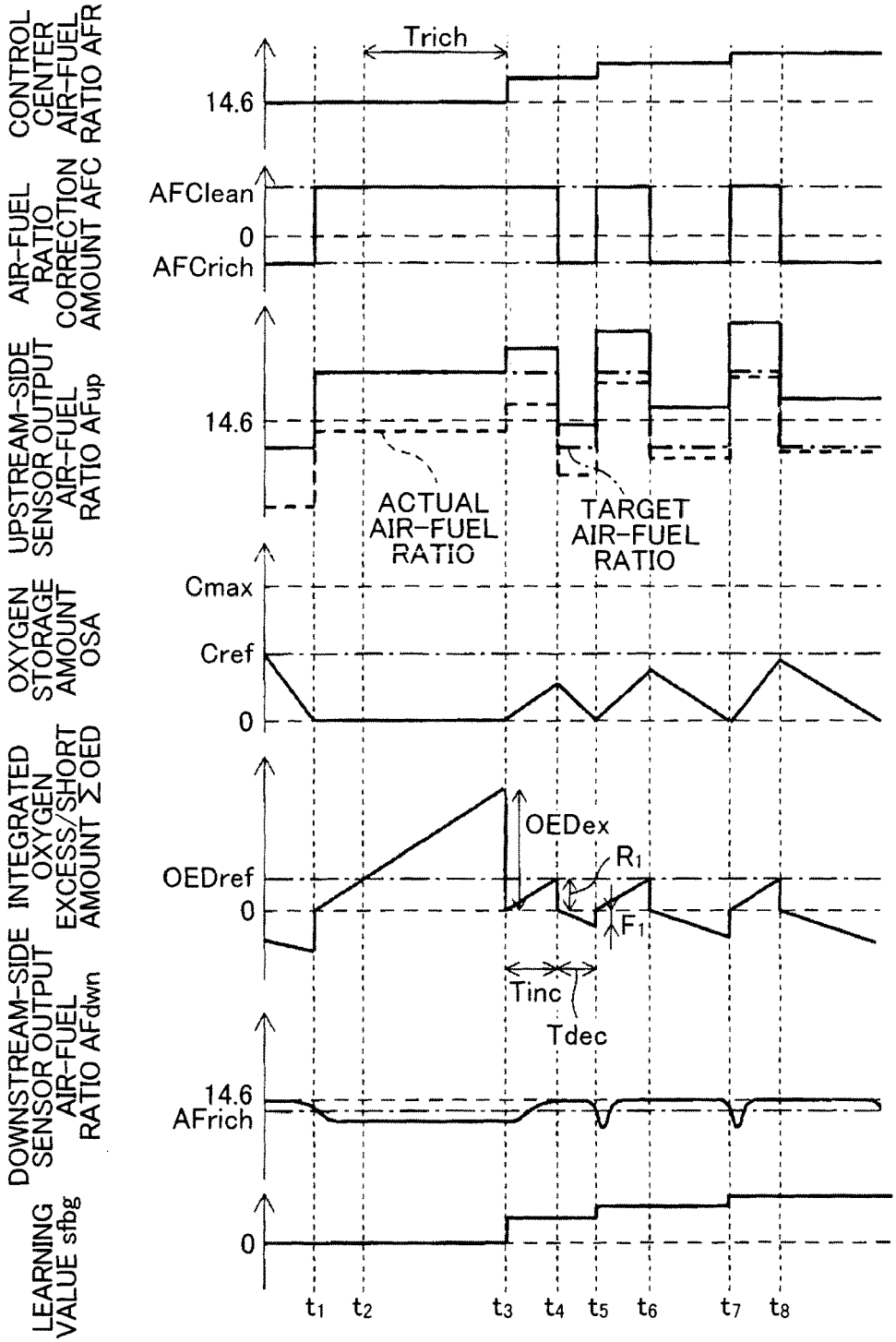
FIG. 17 includes time charts of the air-fuel ratio correction amount and the like when remaining learning control is executed.

FIG. 17 includes time charts of the air-fuel ratio correction amount AFC and the like, which are similar to those in FIG. 16, when the air-fuel ratio control of this embodiment is executed. Also in an example shown in FIG. 17, the air-fuel ratio correction amount AFC is set to the rich setting correction amount AFCrich prior to the time $t_1$. In addition, at the time $t_1$, the output air-fuel ratio AFdwn of the downstream-side air-fuel ratio sensor 41 reaches the rich determination air-fuel ratio AFrich, and the air-fuel ratio correction amount AFC is switched to the lean setting correction amount AFClean. However, since the output air-fuel ratio AFup of the upstream-side air-fuel ratio sensor 40 is significantly deviated to the lean side, the actual air-fuel ratio of the exhaust gas remains at the rich air-fuel ratio even at the time $t_1$ onward. Accordingly, the output air-fuel ratio AFdwn of the downstream-side air-fuel ratio sensor 41 is maintained to be equal to or lower than the rich determination air-fuel ratio AFrich. Therefore, even at the time $t_2$ at which the integrated oxygen excess/short amount ΣOED from the time $t_1$ reaches the switching reference value OEDref, the output air-fuel ratio AFdwn of the downstream-side air-fuel ratio sensor 41 remains to be equal to or lower than the rich determination air-fuel ratio AFrich.

Similar to the example (the time $t_4$) shown in FIG. 11, also in the example shown in FIG. 17, the output air-fuel ratio AFdwn of the downstream-side air-fuel ratio sensor 41 remains to be equal to or lower than the rich determination air-fuel ratio AFrich at the time $t_2$. Accordingly, the air-fuel ratio correction amount AFC is not switched to the rich setting correction amount AFCrich but is maintained in the lean setting correction amount AFClean.

In addition, in this embodiment, in the case where the output air-fuel ratio AFdwn of the downstream-side air-fuel ratio sensor 41 is maintained at the rich air-fuel ratio until the integrated oxygen excess/short amount ΣOED from the time $t_1$ reaches a predetermined remaining determination reference value OEDex that is larger than the switching reference value OEDref, the control center air-fuel ratio AFR is corrected. In particular, in this embodiment, the learning value sfbg is corrected such that the air-fuel ratio of the exhaust gas flowing into the upstream-side exhaust gas control catalyst 20 is changed to be on the lean side. In the example shown in FIG. 17, the learning value sfbg is increased by a predetermined specified value at the time $t_3$. Noted that the remaining determination reference value OEDex is, for example, set to be 1.5 times as large as the switching reference value OEDref or larger, preferably twice as large as the switching reference value OEDref or larger, or more preferably three times as large as the switching reference value OEDref or larger. Noted that, in this embodiment, the integrated oxygen excess/short amount ΣOED is reset to zero at the time $t_3$.

When the learning value sfbg is increased at the time $t_3$, the air-fuel ratio of the exhaust gas flowing into the upstream-side exhaust gas control catalyst 20 is changed to be on the lean side. Accordingly, at the time $t_3$ onward, the deviation in the actual air-fuel ratio of the exhaust gas flowing into the upstream-side exhaust gas control catalyst 20 from the target air-fuel ratio is smaller than that prior to the time $t_3$. Thus, at the time $t_3$ onward, a difference between a broken line indicating the actual air-fuel ratio and a dot and dash line indicating the target air-fuel ratio is smaller than the difference prior to the time $t_3$.

In the example shown in FIG. 17, when the control center air-fuel ratio AFR is corrected at the time $t_3$, the actual air-fuel ratio of the exhaust gas flowing into the upstream-side exhaust gas control catalyst 20 (the broken line in the chart) becomes the lean air-fuel ratio. Accordingly, at the time $t_3$ onward, the oxygen storage amount OSA of the upstream-side exhaust gas control catalyst 20 is gradually increased. In addition, the output air-fuel ratio AFdwn of the downstream-side air-fuel ratio sensor 41 is increased and converged to the theoretical air-fuel ratio. Thereafter, at the time $t_4$, when the integrated oxygen excess/short amount ΣOED from the time $t_3$ reaches the switching reference value OEDref, the output air-fuel ratio AFdwn of the downstream-side air-fuel ratio sensor 41 is converged to the theoretical air-fuel ratio.

In the case where the output air-fuel ratio AFdwn of the downstream-side air-fuel ratio sensor 41 is higher than the rich determination air-fuel ratio AFrich when the integrated oxygen excess/short amount ΣOED reaches the switching reference value OEDref at the time $t_4$, the air-fuel ratio correction amount AFC is no longer needs to be maintained in the lean setting correction amount AFClean. Thus, in this embodiment, the air-fuel ratio correction amount AFC is switched from the lean setting correction amount AFClean to the rich setting correction amount AFCrich at the time $t_4$.

When the air-fuel ratio correction amount AFC is switched to the rich setting correction amount AFCrich at the time $t_4$, the actual air-fuel ratio of the exhaust gas flowing into the upstream-side exhaust gas control catalyst 20 (the broken line in the chart) is changed to the rich air-fuel ratio. In conjunction with this, the oxygen storage amount OSA of the upstream-side exhaust gas control catalyst 20 is gradually decreased and becomes approximately zero around the time $t_5$. As a result, the output air-fuel ratio AFdwn of the downstream-side air-fuel ratio sensor 41 becomes equal to or lower than the rich determination air-fuel ratio AFrich at the time $t_5$, and the air-fuel ratio correction amount AFC is switched from the rich setting correction amount AFCrich to the lean setting correction amount AFClean again.

At the time $t_5$, $R_1$ that is the absolute value of the integrated oxygen excess/short amount ΣOED in the oxygen increase period Tinc from the time $t_3$ to the time $t_4$ is calculated. In addition, $F_1$ that is the absolute value of the integrated oxygen excess/short amount ΣOED in the oxygen decrease period Tdec from the time $t_4$ to the time $t_5$ is calculated. Thereafter, the excess/short amount error ΔΣOED that is the difference between these $R_1$ and $F_1$ ($=R_1-F_1$) is calculated, and the learning value sfbg is updated on the basis of this the excess/short amount error ΔΣOED by using the above-described equation (2).

In the example shown in FIG. 17, the absolute value $F_1$ of the integrated oxygen excess/short amount ΣOED in the oxygen decrease period Tdec from the time $t_4$ to the time $t_5$ is smaller than the absolute value $R_1$ of the integrated oxygen excess/short amount ΣOED in the oxygen increase period Tinc from the time $t_3$ to the time $t_4$. Accordingly, at the time $t_5$, the learning value sfbg is corrected to increase, and thus the control center air-fuel ratio AFR is corrected to be on the lean side. As a result, at the time $t_5$ onward, the air-fuel ratio of the exhaust gas flowing into the upstream-side exhaust gas control catalyst 20 is changed to be on the lean side as compared to that prior to the time $t_5$. Noted that, similar to the period from the time $t_3$ to the time $t_5$, that is, similar to the control shown in FIG. 9, the learning control is executed at the time $t_5$ onward.

According to this embodiment, the learning value sfbg is updated by rich remaining control, just as described. Thus, when there is the deviation in the output air-fuel ratio AFup of the upstream-side air-fuel ratio sensor 40, this deviation can be compensated by appropriately updating the learning value sfbg. Accordingly, the exhaust gas containing the unburned gas can be suppressed from continuously flowing out of the upstream-side exhaust gas control catalyst 20.

Noted that, in the above embodiment, the learning value sfbg is changed only by the predetermined fixed value at the time $t_3$. However, a degree of change in the learning value sfbg does not always have to be fixed. For example, the degree of change in the learning value sfbg may be changed in accordance with the output air-fuel ratio AFdwn of the downstream-side air-fuel ratio sensor 41 before the learning value sfbg is changed (from the time $t_2$ to the time $t_3$ in FIG. 17). In this case, the degree of change in the learning value sfbg is increased as the output air-fuel ratio AFdwn of the downstream-side air-fuel ratio sensor 41, which is before the learning value sfbg is changed, is lowered (as the richness degree is high).

More specifically, for example, the learning value sfbg is calculated by the equation (5) below, and the control center air-fuel ratio AFR is corrected on the basis of the learning value sfbg by the above equation (3).

$$sfbg(n)=sfbg(n-1)+k_3\cdot(AF\text{Clean}+(14.6-AFdwn)) \quad (5)$$

Noted that, in the above equation (5), $k_3$ is a gain that indicates a degree to which the control center air-fuel ratio AFR is corrected ($0<k_3\leq 1$). The correction amount of the control center air-fuel ratio AFR is increased as the value of the gain $k_3$ is large.

Here, in the example shown in FIG. 17, when the air-fuel ratio correction amount AFC is set to the lean setting correction amount AFClean, the output air-fuel ratio AFdwn of the downstream-side air-fuel ratio sensor 41 is maintained at the rich air-fuel ratio. In this case, the deviation in the upstream-side air-fuel ratio sensor 40 corresponds to the difference between the target air-fuel ratio and the output air-fuel ratio AFdwn of the downstream-side air-fuel ratio sensor 41. When this situation is broken down to elements, it can be said that the deviation in the upstream-side air-fuel ratio sensor 40 approximately equals to a degree that is obtained by adding a difference between the target air-fuel ratio and the theoretical air-fuel ratio (corresponding to the rich setting correction amount AFCrich) and a difference between the theoretical air-fuel ratio and the output air-fuel ratio AFdwn of the downstream-side air-fuel ratio sensor 41. Thus, in this embodiment, as shown in the above equation (5), the learning value sfbg is updated on the basis of a value that is obtained by adding the difference between the output air-fuel ratio AFdwn of the downstream-side air-fuel ratio sensor 41 and the theoretical air-fuel ratio to the lean setting correction amount AFClean.

In addition, in the above embodiment, when the integrated oxygen excess/short amount ΣOED from the time $t_2$ reaches the remaining determination reference value OEDex, the learning value sfbg is updated. However, the update timing of the learning value sfbg may be set on the basis of a parameter other than the integrated oxygen excess/short amount ΣOED. As such a parameter, an elapsed time from the time $t_1$ at which the target air-fuel ratio is switched from the rich air-fuel ratio to the lean air-fuel ratio, an elapsed time from the time $t_2$ at which the integrated oxygen excess/short amount ΣOED reaches the switching reference value OEDref, or the like can be mentioned. In addition, the update timing of the learning value sfbg may be set on the basis of the integrated intake air amount, which is an integrated value of the intake air amount supplied to the combustion chamber 5, from the time $t_1$ or the integrated intake air amount from the time $t_2$.

What has been described above is summarized here. In this embodiment, in the case where a state that the output air-fuel ratio AFdwn of the downstream-side air-fuel ratio sensor 41 is equal to or lower than the rich determination air-fuel ratio AFrich continues even after it is estimated that the oxygen storage amount OSA of the upstream-side exhaust gas control catalyst 20 has become equal to or larger than the switching reference storage amount Cref since switching of the target air-fuel ratio to the lean air-fuel ratio, it can be said that the parameter related to the feedback control is corrected such that the air-fuel ratio of the exhaust gas flowing into the upstream-side exhaust gas control catalyst 20 becomes leaner than before at specified timing after it is estimated that the oxygen storage amount OSA of the upstream-side exhaust gas control catalyst 20 becomes equal to or larger than the switching reference storage amount Cref.

Figure 18:
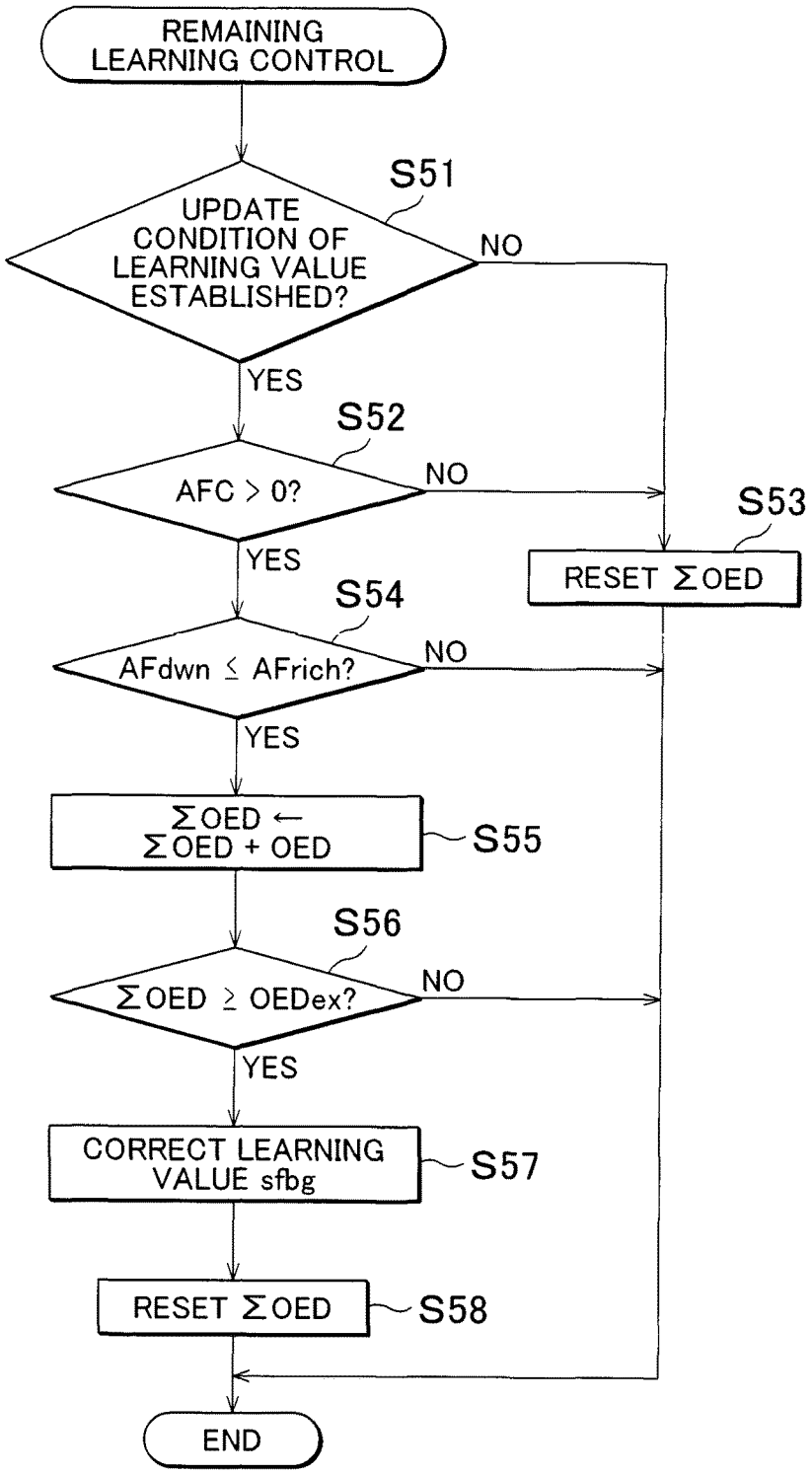
FIG. 18 is a flowchart of a control routine of the remaining learning control.

FIG. 18 is a flowchart of a control routine of remaining learning control in the second embodiment. The illustrated control routine is performed by interruptions at fixed time intervals.

First, similar to step S31, it is determined in step S51 whether the update condition of the learning value sfbg is established. If it is determined in step S31 that the update condition of the learning value sfbg is established, the process proceeds to step S52. In step S52, it is determined whether the air-fuel ratio correction amount AFC is larger than zero, that is, whether the target air-fuel ratio is the lean air-fuel ratio. If it is determined in step S52 that the air-fuel ratio correction amount AFC is equal to or smaller than zero, the integrated oxygen excess/short amount ΣOED is reset to zero in step S53, and the control routine is then terminated.

If it is determined in step S52 that the air-fuel ratio correction amount AFC is larger than zero, the process proceeds to step S54. In step S54, it is determined whether the output air-fuel ratio AFdwn of the downstream-side air-fuel ratio sensor 41 is equal to or lower than the rich determination air-fuel ratio AFrich. If it is determined that the output air-fuel ratio AFdwn of the downstream-side air-fuel ratio sensor 41 is higher than the rich determination air-fuel ratio AFrich, the control routine is terminated. On the other hand, if it is determined in step S54 that the output air-fuel ratio AFdwn of the downstream-side air-fuel ratio sensor 41 is equal to or lower than the rich determination air-fuel ratio AFrich, the process proceeds to step S55. In step S55, the current oxygen excess/short amount OED is added to the integrated oxygen excess/short amount ΣOED, so as to set a new integrated oxygen excess/short amount ΣOED.

Next, in step S56, it is determined whether the integrated oxygen excess/short amount ΣOED, which is calculated in step S56, is equal to or larger than the remaining determination reference value OEDex. If it is determined that the integrated oxygen excess/short amount ΣOED is smaller than the remaining determination reference value OEDex, the control routine is terminated. On the other hand, if it is determined in step S56 that the integrated oxygen excess/short amount ΣOED is equal to or larger than the remaining determination reference value OEDex, the process proceeds to step S57. In step S57, the learning value sfbg is increased by the predetermined fixed value. Next, the integrated oxygen excess/short amount ΣOED is reset to zero in step S58, and the control routine is then terminated. Noted that, in step S58, not only the integrated oxygen excess/short amount ΣOED used in steps S55, S56 but also the integrated oxygen excess/short amount ΣOED used in the normal learning control shown in FIG. 15 is reset to zero.

The invention claimed is:

1. A control apparatus for an internal combustion engine, the internal combustion engine including an exhaust gas control catalyst and a downstream-side air-fuel ratio sensor, the exhaust gas control catalyst arranged in an exhaust passage of the internal combustion engine, the exhaust gas control catalyst configured to store oxygen, the downstream-side air-fuel ratio sensor arranged on a downstream side of the exhaust gas control catalyst in an exhaust gas flow direction in the exhaust passage, and the downstream-side air-fuel ratio sensor configured to detect an air-fuel ratio of the exhaust gas flowing out of the exhaust gas control catalyst, the control apparatus comprising:

an electronic control unit configured to:

execute feedback control of a fuel supply amount supplied to a combustion chamber of the internal combustion engine such that the air-fuel ratio of the exhaust gas flowing into the exhaust gas control catalyst becomes a target air-fuel ratio;

set the target air-fuel ratio at a lean air-fuel ratio that is leaner than a theoretical air-fuel ratio from time at which an output air-fuel ratio of the downstream-side air-fuel ratio sensor becomes equal to or lower than a rich determination air-fuel ratio that is richer than the theoretical air-fuel ratio to time at which an oxygen storage amount of the exhaust gas control catalyst becomes equal to or larger than a specified switching reference storage amount that is smaller than a maximum oxygen storable amount and the output air-fuel ratio of the downstream-side air-fuel ratio sensor becomes higher than the rich determination air-fuel ratio;

set the target air-fuel ratio at a rich air-fuel ratio that is richer than the theoretical air-fuel ratio after the oxygen storage amount of the exhaust gas control catalyst becomes equal to or larger than the switching reference storage amount and the output air-fuel ratio of the downstream-side air-fuel ratio sensor becomes higher than the rich determination air-fuel ratio; and set a leanness degree of the target air-fuel ratio such that the leanness degree of the target air-fuel ratio in a case where the oxygen storage amount of the exhaust gas control catalyst becomes equal to or larger than the switching reference storage amount after the target air-fuel ratio is switched to the lean air-fuel ratio and the output air-fuel ratio of the downstream-side air-fuel ratio sensor is equal to or lower than the rich determination air-fuel ratio is higher than the leanness degree of the target air-fuel ratio in a case where the oxygen storage amount is less than the switching reference storage amount.

2. The control apparatus according to claim 1, wherein the electronic control unit is configured to set the leanness degree of the target air-fuel ratio such that the leanness degree of the target air-fuel ratio is higher as the output air-fuel ratio of the downstream-side air-fuel ratio sensor is lowered.

3. The control apparatus according to claim 1, wherein the electronic control unit is configured to set the target air-fuel ratio at the rich air-fuel ratio that is richer than the theoretical air-fuel ratio from time at which the oxygen storage amount of the exhaust gas control catalyst becomes equal to or larger than the switching reference storage amount and the output air-fuel ratio of the downstream-side air-fuel ratio sensor becomes higher than the rich determination air-fuel ratio.

4. The control apparatus according to claim 1, wherein the electronic control unit is configured to execute learning control for correcting a parameter related to the feedback control on the basis of the output air-fuel ratio of the downstream-side air-fuel ratio sensor, the electronic control unit is configured to calculate a first oxygen amount integrated value, the first oxygen amount integrated value is an absolute value of an integrated oxygen excess or short amount in a first period that is from time at which the target air-fuel ratio is set at the lean air-fuel ratio to time at which it is estimated that the oxygen storage amount of the exhaust gas control catalyst becomes equal to or larger than the switching reference storage amount, the electronic control unit is configured to calculate a second oxygen amount integrated value, the second oxygen amount integrated value is the absolute value of the integrated oxygen excess or short amount in a second period that is from time at which the target air-fuel ratio is set at the rich air-fuel ratio to time at which the output air-fuel ratio of the downstream-side air-fuel ratio sensor becomes equal to or lower than the rich determination air-fuel ratio, and the electronic control unit is configured to correct a parameter related to the feedback control as the learning control such that a difference between the first oxygen amount integrated value and the second oxygen amount integrated value is decreased.

5. The control apparatus according to claim 4, wherein the electronic control unit is configured to correct the parameter related to the feedback control such that the air-fuel ratio of the exhaust gas flowing into the exhaust gas control catalyst in a case where the oxygen storage amount of the exhaust gas control catalyst becomes equal to or larger than the switching reference storage amount after the target air-fuel ratio is switched to the lean air-fuel ratio and the output air-fuel ratio of the downstream-side air-fuel ratio sensor is equal to or lower than the rich determination air-fuel ratio is leaner than that in a case where the oxygen storage amount is less than the switching reference storage amount.

* * * * *